US005694904A

United States Patent [19]

Osanai

[11] Patent Number: 5,694,904

[45] Date of Patent: Dec. 9, 1997

[54] EVAPORATIVE CONTROL SYSTEM FOR MULTICYLINDER INTERNAL COMBUSTION ENGINE

[75] Inventor: Akinori Osanai, Susono, Japan

[73] Assignee: Toyota Jidosha Kabushiki Kaisha, Aichi, Japan

[21] Appl. No.: 785,446

[22] Filed: Jan. 17, 1997

[30] Foreign Application Priority Data

| | | | |
|---|---|---|---|
| Jan. 19, 1996 | [JP] | Japan | 8-007577 |
| Sep. 19, 1996 | [JP] | Japan | 8-248045 |

[51] Int. Cl.[6] ..... F02M 41/00

[52] U.S. Cl. ..... 123/520; 123/436; 123/357

[58] Field of Search ..... 123/520, 357, 123/519, 518, 516, 521, 436

[56] References Cited

U.S. PATENT DOCUMENTS

| | | | |
|---|---|---|---|
| 4,630,581 | 12/1986 | Shibata | 123/519 |
| 4,809,667 | 3/1989 | Uranashi | 123/518 |
| 4,841,940 | 6/1989 | Uranashi | 123/520 |
| 4,961,412 | 10/1990 | Furuyama | 123/357 |
| 5,016,591 | 5/1991 | Nanyoshi | 123/436 |
| 5,465,703 | 11/1995 | Abe | 123/520 |
| 5,469,832 | 11/1995 | Nemoto | 123/520 |
| 5,609,142 | 3/1997 | Osanai | 123/357 |

FOREIGN PATENT DOCUMENTS

| | | |
|---|---|---|
| 4-1658 | 1/1992 | Japan . |
| 6-229330 | 8/1994 | Japan . |
| 6-241129 | 8/1994 | Japan . |

*Primary Examiner*—Carl S. Miller

*Attorney, Agent, or Firm*—Kenyon & Kenyon

[57] ABSTRACT

An evaporative control system for a multicylinder internal combustion engine makes the driving period of a purge control valve for asynchronous to an engine cycle when controlling purged fuel, to keep an air-fuel ratio in the engine stabilized, improve exhaust purifying performance, and prevent lean misfires.

The engine has a canister for storing evaporated fuel from a fuel tank, a purge pipe for connecting the canister to an intake duct of the engine, and a purge control valve disposed in the purge pipe. A driving period changing unit sequentially changes the driving period of the purge control valve from one to another, or changes it so that the start of the driving period may not continuously agree with a crank angle of the engine. A valve controlling unit opens and closes the purge control valve according to the driving period set by the driving period changing unit. A duty factor setting unit sets a minimum valve open time for the purge control valve. A timer unit measures an interval of purge control. A restricting unit restricts the change of the driving period of the purge control valve according to a duty factor.

11 Claims, 21 Drawing Sheets

EVAPORATIVE CONTROL SYSTEM FOR MULTICYLINDER INTERNAL COMBUSTION ENGINE

BACKGROUND OF THE INVENTION

1. Field of the Invention

The present invention relates to an evaporative control system for a multicylinder internal combustion engine, and particularly, to one that makes the driving period of a purge control valve asynchronous to an engine cycle when controlling purged fuel, to keep an air-fuel ratio in the engine stable.

2. Description of the Related Art

An evaporative control system of an internal combustion engine has a canister for temporarily storing evaporated fuel from a fuel tank, a purge pipe for connecting the canister to an intake duct of the engine, and a purge control valve disposed in the purge pipe. The purge control valve is activated depending on the operating conditions of the engine and is opened and closed at a given frequency in response to a pulse signal having a given duty factor. If a period of the pulse signal is substantially synchronized with an engine cycle, fuel purged from the canister will be drawn into a specific cylinder of the engine to make an air-fuel ratio in the cylinder rich and an air-fuel ratio in any other cylinder that draws no purged fuel lean, thereby fluctuating an air-fuel ratio in the engine as a whole and causing misfires in the lean cylinders. To solve this problem, Japanese Unexamined Patent Publication No. 6-241129 changes the driving frequency, or the driving period of the purge control valve when it is substantially synchronized with an engine cycle.

This prior art suddenly changes the driving frequency of the purge control valve at a boundary where it is substantially synchronized with an engine cycle. This results in fluctuating an air-fuel ratio in the engine. To converge the fluctuating air-fuel ratio to a target air-fuel ratio, the disclosure corrects a fuel injection quantity. It takes time, however, until the fluctuation is stabilized at the target air-fuel ratio.

An object of the present invention is to provide an evaporative control system for a multicylinder internal combustion engine, capable of keeping an air-fuel ratio stabilized even if the driving period of a purge control valve is substantially synchronized with an engine cycle, thereby maintaining exhaust purifying performance and preventing lean misfires.

SUMMARY OF THE INVENTION

FIG. 1 shows a basic arrangement of an evaporative control system for a multicylinder internal combustion engine according to the present invention. The engine 1 has a canister 37 for temporarily storing evaporated fuel from a fuel tank 15, a purge pipe 39 for connecting the canister 37 to an intake duct of the engine 1, and a purge control valve 41 disposed in the purge pipe 39, to control the quantity of fuel to be purged from the canister 37 into the intake duct. A driving period changing unit A always changes, while the engine 1 is running, the driving period of the purge control valve 41 independently of an engine revolution speed, so that fuel purged from the canister 37 is equally distributed to each cylinder of the engine 1. A valve controlling unit B opens and closes the purge control valve 41 according to the driving period set by the unit A and a duty factor determined according to the operating conditions of the engine 1. More precisely, the driving period of the purge control valve 41 is always changed by changing the frequency of a pulse signal that drives the valve 41 among, for a first example, 10 Hz, 15 Hz, and 20 Hz in order of to 10 Hz, 15 Hz, 20 Hz, 15 Hz, 10 Hz, 15 Hz, and the like, a second example, 10 Hz and 15 Hz in order or 10 Hz, 15 Hz, 10 Hz, 15 Hz, 10 Hz, 15 Hz, and the like, or else.

In this way, the driving period changing unit A continuously changes, while the engine 1 is running, the driving period of the purge control valve 41 independently of an engine revolution speed, so that fuel purged from the canister 37 is equally distributed to each cylinder of the engine 1, to stabilize an air-fuel ratio in the engine 1.

Unlike the Japanese Unexamined Patent Publication No. 6-241129 that suddenly changes the flow rate of purged fuel around a specific engine revolution speed, to fluctuate an air-fuel ratio, the present invention always changes the driving period of the purge control valve independently of an engine revolution speed, so that there is no sudden change in the flow rate of purged fuel nor fluctuation in an air-fuel ratio.

The driving period changing unit A may change the driving period of the purge control valve 41 among a plurality of driving periods according to a given order. According to the driving period set thereby, the valve controlling unit B drives the purge control valve 41.

As a result, the driving period of the purge control valve will never be synchronized with an engine cycle, and therefore, an air-fuel ratio in the engine will be stable for an entire range of engine revolution speeds.

The evaporative control system may have a duty factor setting unit C for setting a minimum valve open time for the purge control valve 41 for each of the driving periods. According to the minimum valve open time set by the duty factor setting unit C, the valve controlling unit B drives the purge control valve 41.

This results in surely opening the purge control valve 41.

The evaporative control system may have a timer unit D for measuring an interval of purge control. If the measured interval exceeds a reference value, the driving period changing unit A fixes the driving period of the purge control valve 41.

If the measured interval is smaller than the reference value, it means that the amount of fuel adsorbed in the canister 37 is too much to fluctuate an air-fuel ratio in the engine 1. Then, the driving period changing unit A sequentially changes the driving period of the purge control valve 41 from one to another and the valve controlling unit B drives the purge control valve 41 accordingly, to stabilize the air-fuel ratio. If the measured interval is larger than the reference value, it means that the amount of fuel adsorbed in the canister 37 is too small to fluctuate the air-fuel ratio. Then, the driving period changing unit A fixes the driving period of the purge control valve 41.

The driving period changing unit A may have a restricting unit E for restricting the driving period of the purge control valve 41 according to a duty factor.

The restricting unit E restricts the change of the driving period of the purge control valve 41 if a duty factor is low or high, to correctly control the flow rate of purged fuel.

The driving period changing unit A changes the driving period of the purge control valve 41 so that the start of a driving period of the purge control valve 41 may not continuously agree with a revolution phase (a crank angle) of the engine.

As a result, the driving period of the purge control valve 41 is not continuously synchronized with an engine cycle, purged fuel is not drawn into a specific cylinder, and an air-fuel ratio is stabilized.

The driving period changing unit A may have a cylinder identifying unit for identifying a first cylinder that draws purged fuel in the present driving period of the purge control valve 41, and a driving period setting unit for setting the driving period of the purge control valve 41 so that a second cylinder that draws purged fuel in the next driving period of the purge control valve 41 may differ from the first cylinder.

The cylinder identifying unit and driving period setting unit prevent a specific cylinder from continuously drawing purged fuel. As a result, purged fuel is equally distributed to each cylinder of the engine, to stabilize an air-fuel ratio in the engine.

The driving period changing unit A may have a first correction unit for correcting the driving period of the purge control valve 41 according to a crank angle at the start of the present driving period of the valve 41.

The first correction unit corrects the driving period of the purge control valve 41 so that a crank angle at the start of the present driving period of the valve 41 may disagree with a crank angle at the start of the next driving period thereof. As a result, purged fuel is equally distributed to each cylinder to stabilize an air-fuel ratio in the engine.

The driving period changing unit A may have an estimation unit for estimating an engine revolution speed, and a second correction unit for correcting the driving period of the purge control valve 41 according to the estimated engine revolution speed.

As a result, purged fuel is not continuously drawn into a specific cylinder, purged fuel is equally distributed to each cylinder during a transient period, and an air-fuel ratio in the engine is stable even during the transient period.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

The preferred embodiments of the present invention will be described below with reference to the accompanying drawings.

Figure 1:
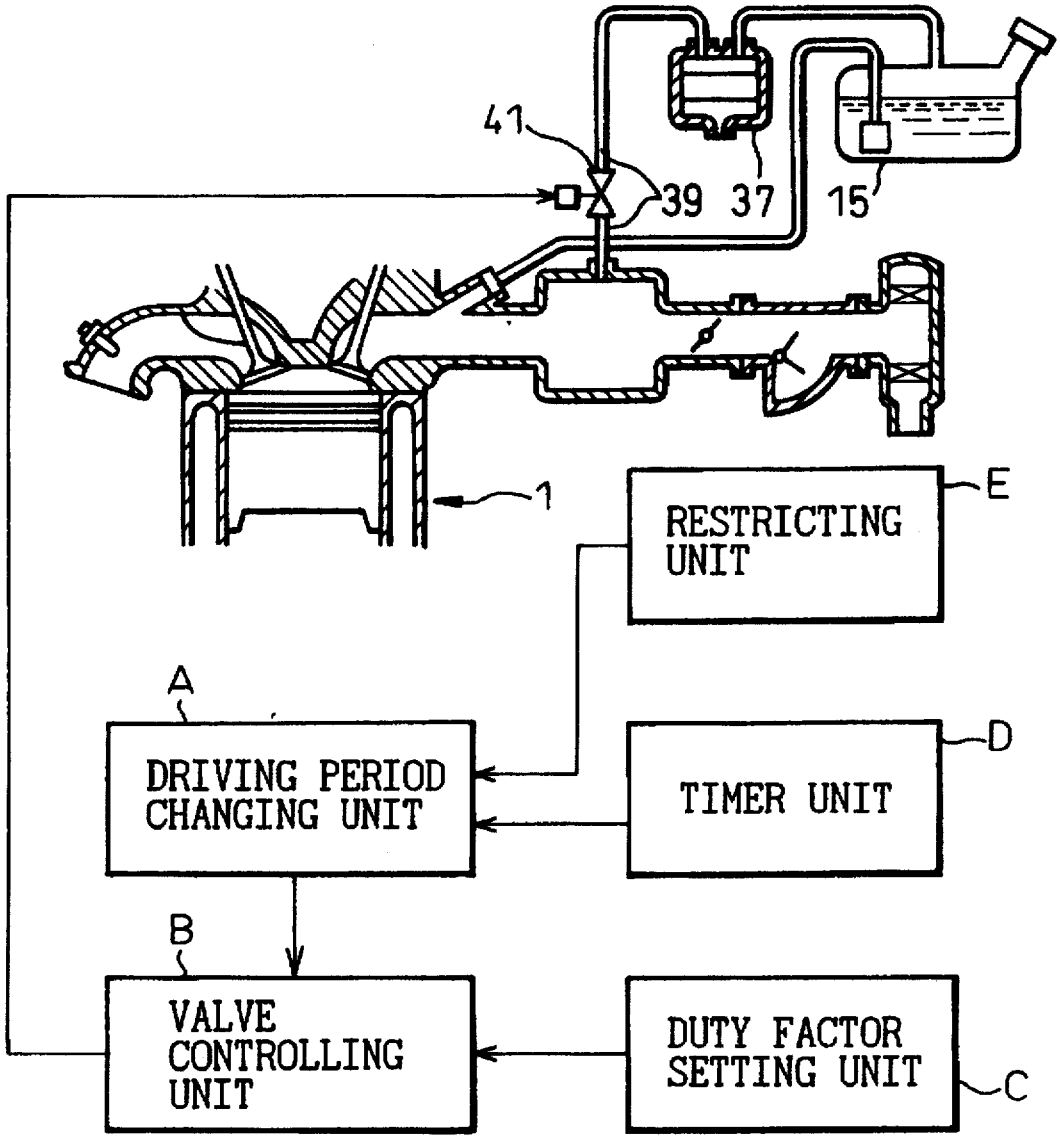
FIG. 1 shows a basic arrangement of an evaporative control system for a multicylinder internal combustion engine according to the present invention.
Figure 2:
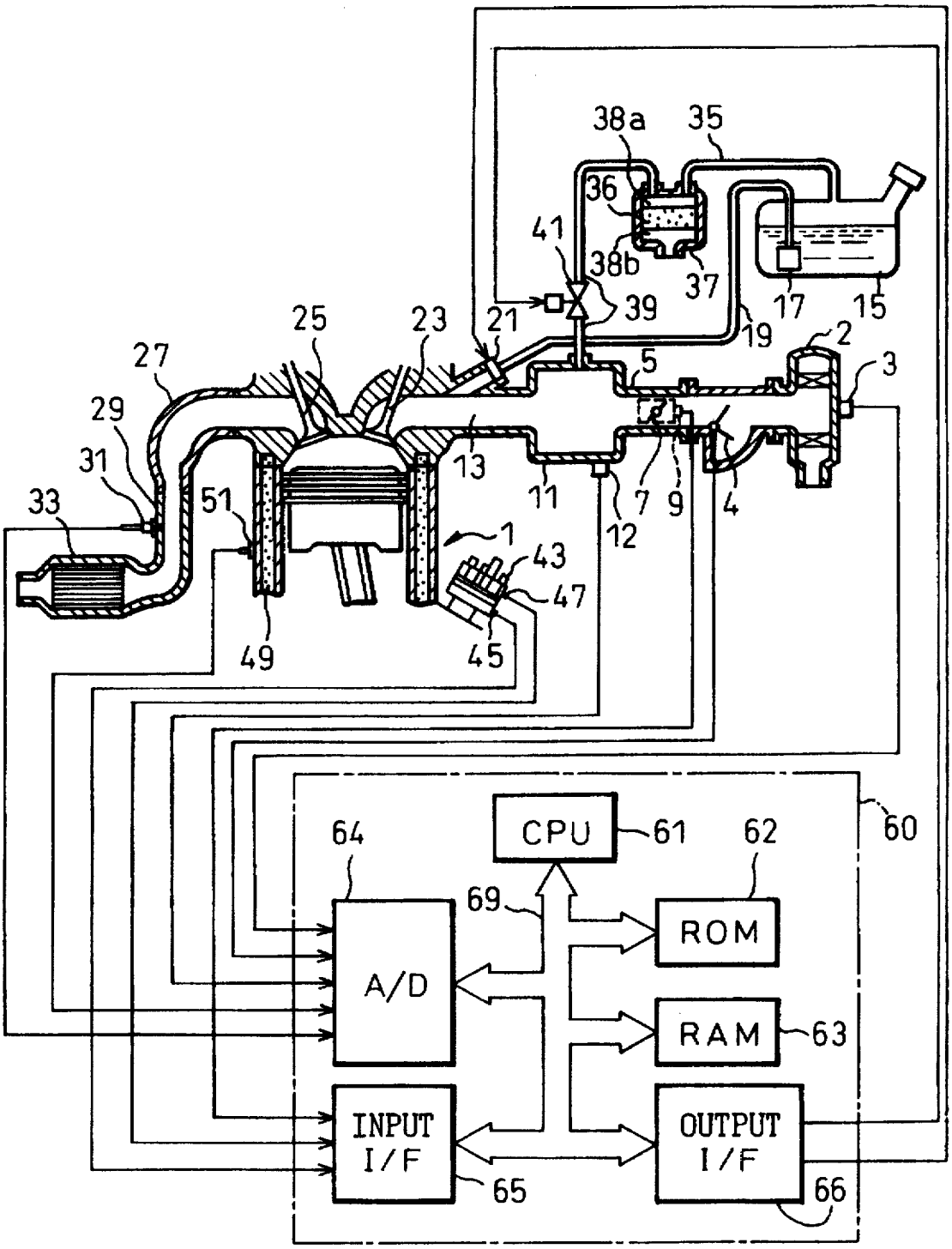
FIG. 2 is a general view showing an evaporative control system for a multicylinder internal combustion engine according to an embodiment of the present invention.

FIG. 2 shows an evaporative control system for a multicylinder internal combustion engine according to an embodiment of the present invention. The engine 1 receives air used for combustion from an air cleaner 2 through a throttle body 5, a surge tank 11, and an intake duct 13 of each cylinder. The throttle body 5 has a throttle valve 7 for adjusting the quantity of intake air, which is measured by an airflow meter 4. A throttle opening sensor 9 detects the opening of the throttle valve 7. An intake air temperature sensor 3 detects the temperature of intake air. A vacuum sensor 12 detects a pressure in the intake duct 13.

A fuel tank 15 fuel, which is pumped up by a fuel pump 17 and is passed through a fuel pipe 19 and is injected by a fuel injector 21 into the intake duct 13. A mixture of air and fuel in the intake duct 13 is drawn into a cylinder through a suction valve 23. In the cylinder, the mixture is compressed by a piston, is ignited by an igniter and a spark plug and is burnt to produce torque.

An ignition distributor 43 has a reference position sensor 45 and a crank angle sensor 47. The sensor 45 generates a pulse signal representing a reference position at every crank angle of 720 degrees. The sensor 47 generates a pulse signal representing a position at every crank angle of 30 degrees.

A cooling water path 49 guides water for cooling the engine 1, and a water temperature sensor 51 detects the temperature of the cooling water.

Exhaust gas after combustion is discharged into an exhaust manifold 27 through an exhaust valve 25 and then into an exhaust pipe 29. The exhaust pipe 29 has an air-fuel ratio sensor 31 for detecting the oxygen concentration in the exhaust gas. A catalytic converter 33 is arranged in the exhaust pipe 29 downstream from the sensor 31. The catalytic converter 33 accommodates a three-way catalyst for oxidizing unburned HC and CO and reducing nitrogen oxides contained in exhaust gas. The exhaust gas cleaned by the catalytic converter 33 is discharged into atmosphere.

A canister 37 has activated carbon 36 as adsorbent. On each side of the activated carbon 36, the canister 37 has an evaporated fuel chamber **38*a* and an atmospheric chamber 38*b*. The chamber 38*a* is connected to the fuel tank 15 through a vapor collecting pipe 35 and to the surge tank 11 downstream from the throttle valve 7 through a purge pipe 39. The purge pipe 39 has a purge control valve 41 for controlling the quantity of purged fuel. Evaporated fuel in the fuel tank 15 is guided into the canister 37 through the pipe 35 and is adsorbed by the activated carbon 36. When the purge control valve 41 is opened, a negative pressure in the intake duct 13 draws air from the atmospheric chamber 38*b* through the activated carbon 36 and purge pipe 39. When the air passes through the activated carbon 36, the fuel adsorbed in the activated carbon 36 is removed therefrom. As a result, the air containing the removed fuel is purged into the surge tank 11 through the purge pipe 39 and is combusted in each cylinder together with fuel injected from the fuel injector 21. In addition to the fuel from the activated carbon 36, evaporated fuel in the fuel tank 15 is directly guided to the purge pipe 39**.

The engine 1 has an electronic control unit (ECU) 60. The control unit 60 is a microcomputer for carrying out fuel injection control, ignition timing control, etc., according to the operating conditions of the engine 1 detected from an engine revolution speed and signals from sensors. For example, the control unit 60 determines optimum ignition timing and sends an ignition signal to the igniter. The control unit 60 has a ROM 62 for storing a program. According to the program, a CPU 61 receives signals from the sensors through an A/D converter 64 and an input interface 65, processes the signals, and provides control signals to actuators through an output interface 66. A RAM 63 temporarily stores data. These elements in the control unit 60 are connected to one another through a system bus 69 including an address bus, a data bus, and a control bus. Control operations carried out by the control unit 60 will be explained.

Figure 3:
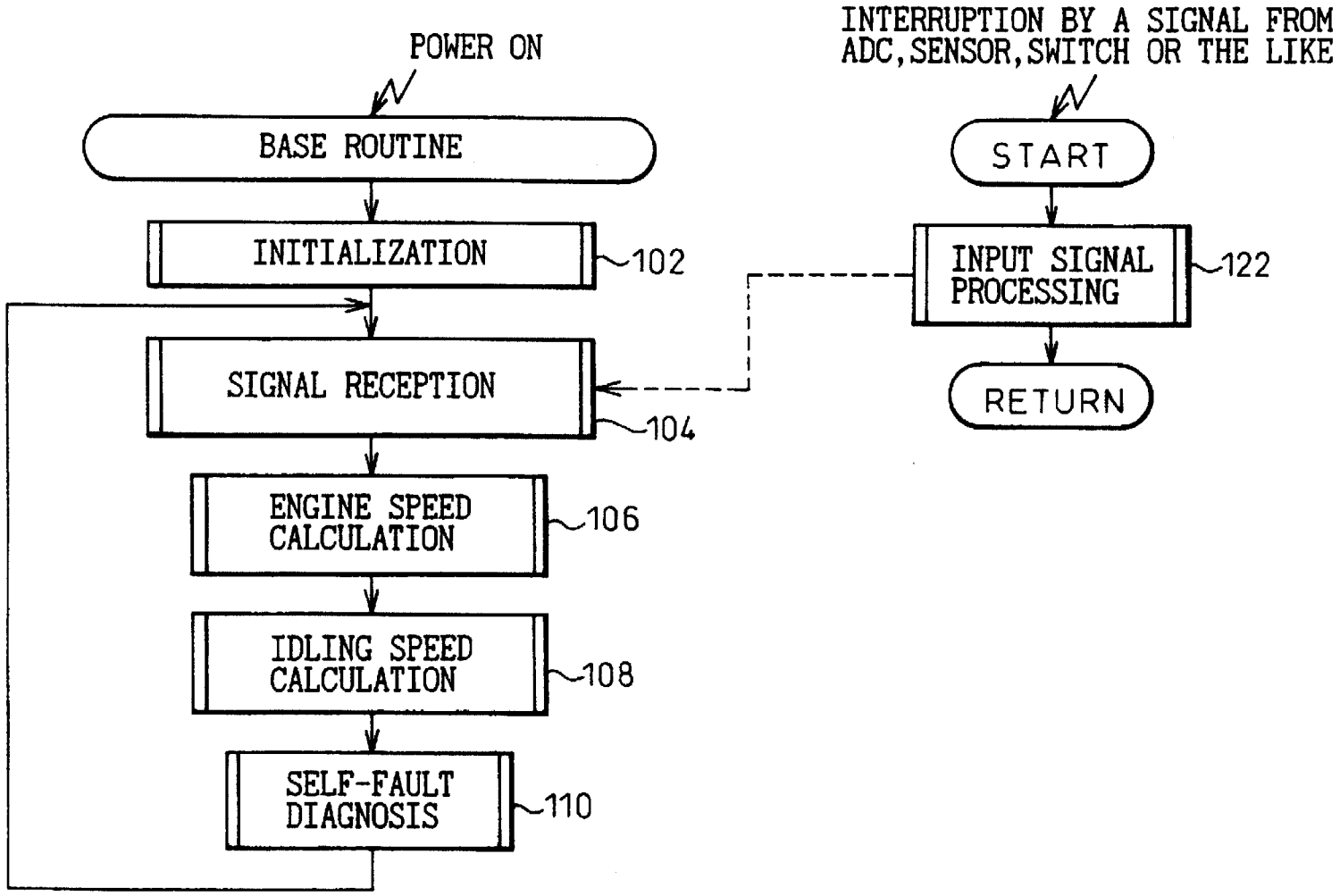
FIG. 3 is a flowchart showing a basic control routine according to the present invention.
Figure 4:
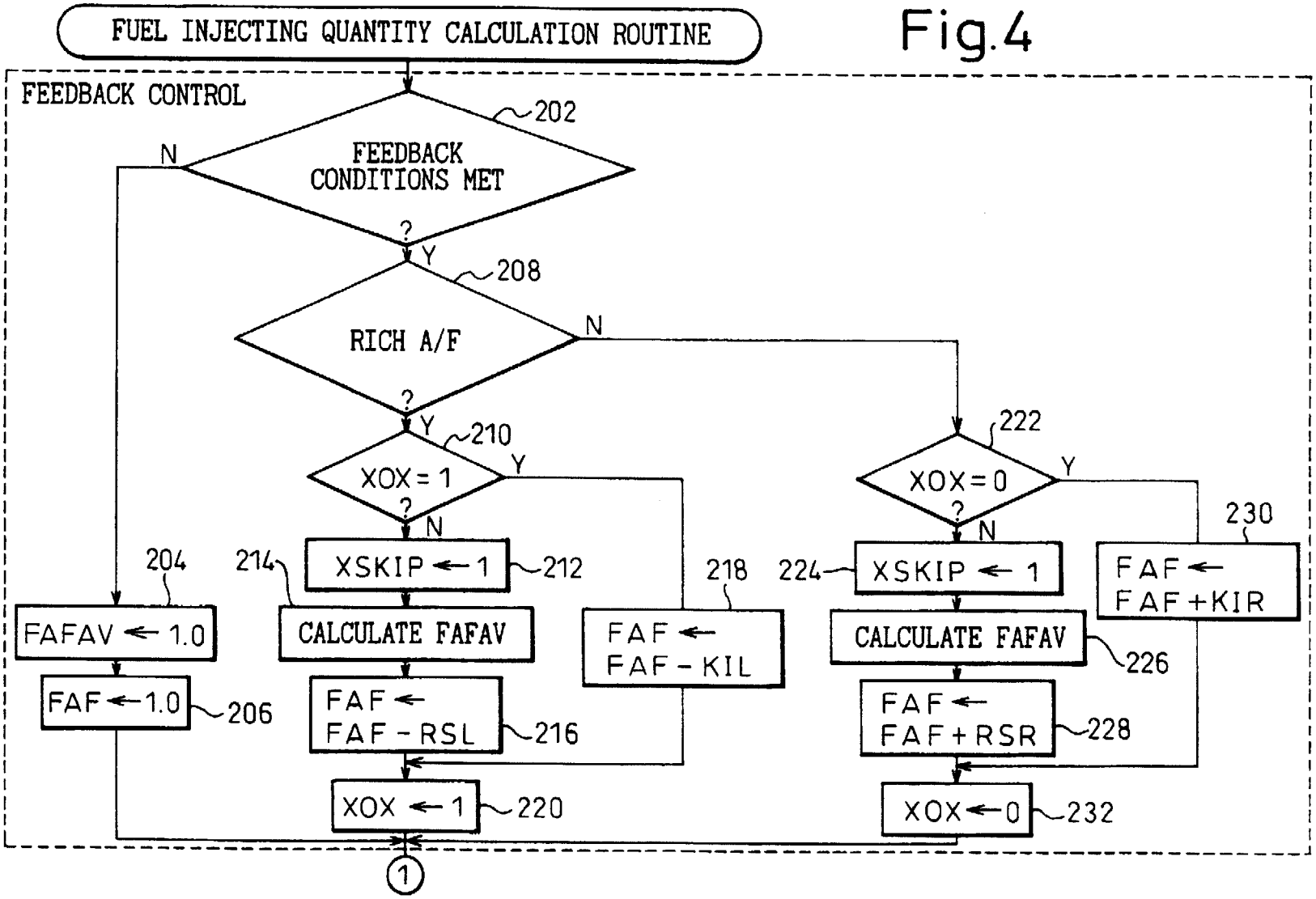
FIG. 4 is a flowchart showing an air-fuel ratio feedback control routine according to the present invention.

FIG. 3 is a flowchart showing a basic control routine according to the present invention for controlling the engine 1 of FIG. 2. The control unit 60 performs the basic routine in a loop. During the basic routine, interrupts are carried out regularly or irregularly in response to any input signal or an engine revolution speed. When turned on, the control unit 60 carries out initialization in step 102, receives signals from the sensors and switches in step 104, calculates an engine revolution speed in step 106, calculates an idling speed in step 108, and carries out a self-diagnosis in step 110. These steps are repeated regularly. Step 122 carries out an interrupt of receiving a signal from the A/D converter 64, from some sensor, or from some switch. Calculated fuel injection timing and ignition timing are supplied to corresponding actuators in synchronization with a signal from the crank angle sensor 47. Other processes are carried out at regular intervals as timer interrupt routines.

The airflow meter 4 provides the quantity of intake air, and the crank angle sensor 47 provides an engine revolution speed. These data are used to calculate the quantity of injecting fuel, i.e., an injection time of the fuel injector 21, so that the fuel injector 21 injects the calculated fuel at a given crank angle. The fuel injection time is corrected according to signals from the throttle opening sensor 9, water temperature sensor 51, intake temperature sensor 3, etc. The fuel injection time is also subjected to an air-fuel ratio feedback correction based on a signal from the air-fuel ratio sensor 31, an air-fuel ratio learning correction for bringing a central value of the air-fuel ratio feedback correction to a theoretical air-fuel ratio, and a correction based on the quantity of fuel purged from the canister 37. The present invention relates to controlling the fuel purged from the canister 37 and correcting the quantity of injecting fuel accordingly. A fuel injection calculation routine and a purge control routine according to the present invention will be explained. These routines are carried out as timer interrupts.

FIGS. 4 to 7 are flowcharts showing the fuel injection calculation routine according to the present invention. The routine is carried out as a timer interrupt at regular intervals of, for example, 1 msec and is composed of air-fuel ratio feedback control of FIG. 4, air-fuel ratio learning control of FIG. 5, vapor concentration learning control of FIG. 6, and fuel injection time (TAU) calculation control of FIG. 7. The air-fuel ratio feedback control will be explained with reference to FIG. 4.

Step 202 checks to see if all of the following air-fuel ratio feedback control conditions are met:

(1) engine having been started (2) fuel being supplied (3) cooling water temperature≧40° C.

(4) air-fuel ratio sensor being active

If all conditions are met, step 208 checks to see if an air-fuel ratio is rich, i.e., if an output voltage of the air-fuel ratio sensor 31 is lower than a reference voltage, for example, 0.45 V.

If the air-fuel ratio is rich, step 210 checks a rich flag XOX to see if it is 1 and determines whether or not a preceding air-fuel ratio is rich. If XOX≠1, step 212 sets a skip flag XSKIP to 1. Step 214 calculates an average FAFAV between preceding and present air-fuel ratio feedback correction coefficients (FAFs). Step 216 subtracts a skip quantity RSL from the correction coefficient FAF. If XOX=1 in step 210, step 218 subtracts an integral quantity KIL from the correction coefficient FAF. Step 220 sets the flag XOX to 1 to complete the air-fuel ratio feedback control. Thereafter, the air-fuel ratio learning control (step 302) is carried out.

If the air-fuel ratio is lean in step 208, step 222 checks to see if XOX=0 and determines whether or not a preceding air-furl ratio is lean. If XOX≠0, step 224 sets the skip flag XSKIP to 1. Step 226 calculates an average FAFAV between preceding and present air-fuel ratio feedback correction coefficients (FAFs). Step 228 adds a skip quantity RSR to the correction coefficient FAF. If XOX=0 in step 222, step 230 adds an integral quantity KIR to the correction coefficient FAF. Step 232 resets the flag XOX to 0 to complete the feedback control routine. Thereafter, the air-fuel ratio learning control (step 302) is carried out.

If the feedback conditions are not met in step 202, steps 204 and 206 set FAFAV and FAF each to a reference value of 1.0 to complete the feedback control routine. Thereafter, the air-fuel ratio learning control (step 302) is carried out.

The air-fuel ratio learning control of FIG. 5 will be explained. Step 302 finds a learning area j (j=1 to 7)

according to a pressure in the intake duct 13 detected by the vacuum sensor 12. There are learning areas 1 to 7 depending on pressures in the intake duct 13. The learning area found is set as tj (j=1 to 7). Step 304 checks tj to see if it is equal to a preceding learning area j. If tj≠j, step 306 sets tj to j, and step 310 clears a skip number CSKIP to complete the air-fuel ratio learning control. Thereafter, the vapor concentration learning control (step 402) is carried out.

If tj=j in step 304, step 308 checks to see if all of the following conditions for air-fuel ratio learning control are met:

(1) air-fuel ratio feedback control being carried out (2) no fuel increase after starting engine or during warming-up (3) cooling water temperature≧80° C.

If any one of the conditions is not met, step 310 clears the skip number CSKIP to complete the air-fuel ratio learning control. Thereafter, the vapor concentration learning control (step 402) is carried out.

If all of the conditions are met in step 308, step 312 checks the skip flag XSKIP to see if it is 1, i.e., whether or not it is just after skipping. If XSKIP≠1, the air-fuel ratio learning control is terminated, and the vapor concentration learning control (step 402) is carried out. If XSKIP=1, step 314 clears the skip flag XSKIP to 0, and step 316 increments the skip number CSKIP by one. Step 318 checks to see if CSKIP≧KCSKIP, where KCSKIP is a reference number and is, for example, 3. If CSKIP<KCSKIP, the air-fuel ratio learning control ends, and the vapor concentration learning control (step 402) is carried out.

If CSKIP≧KCSKIP in step 318, step 320 determines whether or not a purge ratio PGR is 0. The purge ratio PGR is the ratio of the quantity of purged fuel to the quantity of intake air and is calculated in the purge control routine to be explained later. If PGR≠0, i.e., if fuel is being purged, the air-fuel ratio learning control ends, and the vapor concentration learning control (step 410) is carried out. If PGR=0, i.e., if no fuel is being purged, the averaged correction coefficient FAFAV set in one of steps 204, 214, and 226 of the feedback control routine is checked to see if it is greater than a reference value, for example, 1.02. According to a deviation of the averaged correction coefficient FAFAV, a learning value KGj (j=1 to 7) for the learning area j is determined. If FAFAV≧1.02 in step 322, step 324 adds a value x to the learning value KGj. If FAFAV<1.02 in step 322 and if FAFAV≦0.98 in step 326, step 328 subtracts the value x from the learning value KGj. In any other case, step 330 sets an air-fuel ratio learning completion flag XKGj for the learning area j to 1. After the air-fuel ratio learning control, the vapor concentration learning control (step 402) is carried out.

Figure 6:
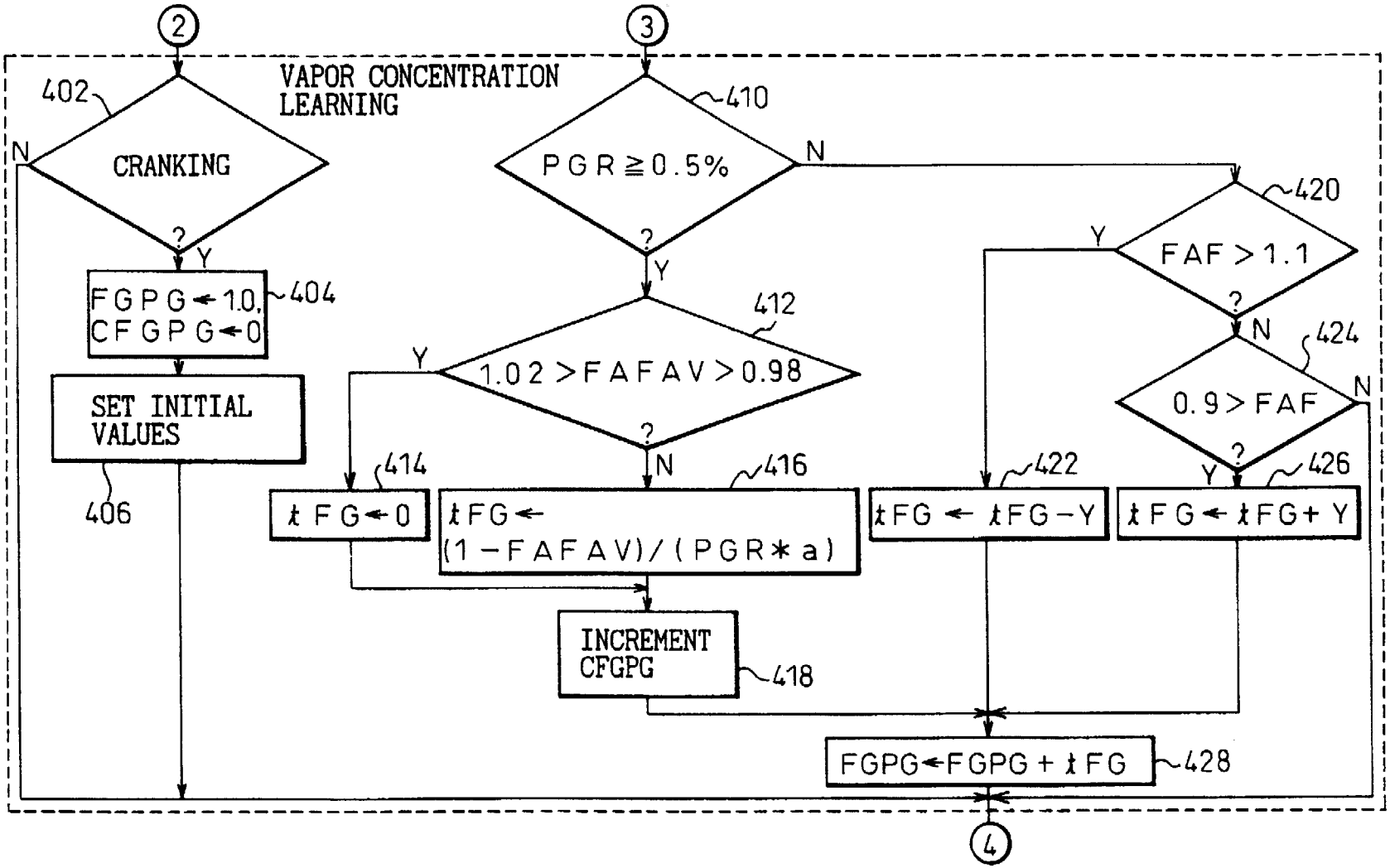
FIG. 6 is a flowchart showing a vapor concentration learning control routine according to the present invention.

The vapor concentration learning control of FIG. 6 will be explained. Step 402 checks to see if the engine is starting. Namely, step 402 checks to see if an engine revolution speed after an ignition key has been turned on is a cranking speed. If the engine has been started already, the vapor concentration learning control ends, and the fuel injection time (TAU) calculation control (step 452) is carried out. If the engine is starting, step 404 sets a vapor concentration FGPG to a reference value of 1.0 and clears a counter CFGPG for counting the number of times of updating a vapor concentration to 0. Step 406 initializes a preceding duty factor DPGO, a preceding purge ratio PGRO, etc., to zero.

Figure 5:
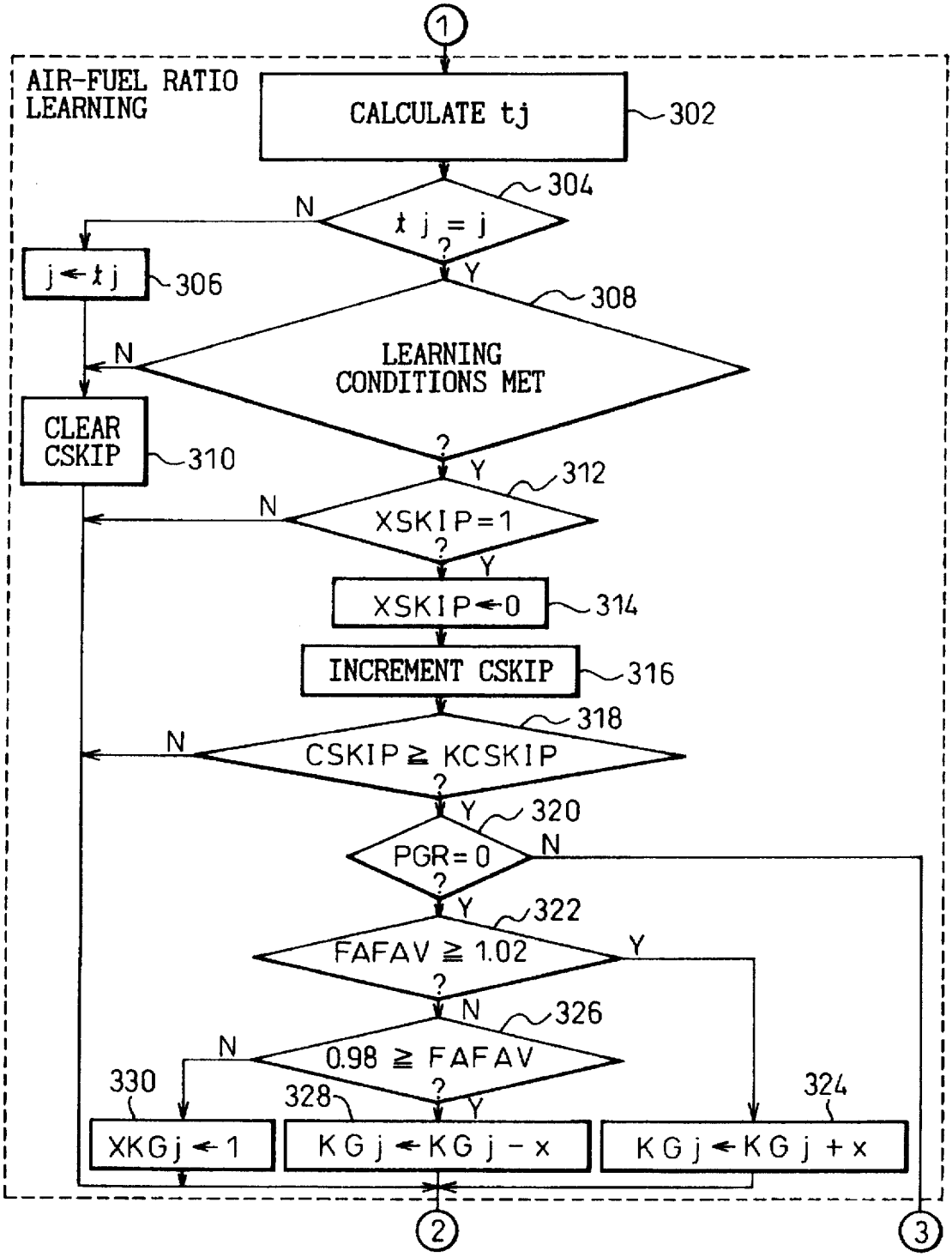
FIG. 5 is a flowchart showing an air-fuel ratio learning control routine according to the present invention.

If PGR≠0 in step 320 of the air-fuel ratio learning control of FIG. 5, step 410 determines if the purge ratio PGR is larger than, for example, 0.5%. If PGR≧0.5%, step 412 checks to see if the averaged correction coefficient FAFAV is within a range of ±2% around a reference value of 1.0. If 1.02>FAFAV>0.98, step 414 sets a vapor concentration updating value tFG per purge ratio to 0, and if not, step 416 calculates tFG as follows:

$$tFG \leftarrow (1-FAFAV)/(PGR*a)$$

where "a" is a given value, for example, 2.

Step 418 increments the counter CFGPG by one, and step 428 is carried out.

If PGR<0.5% in step 410, it is determined that vapor concentration updating accuracy is bad. Accordingly, step 420 checks to see if a deviation of the air-fuel ratio feedback correction coefficient FAF is ±10% or larger with respect to a reference value of 1.0. If FAF≦1.1 in step 420, step 422 subtracts a given value Y from the vapor concentration updating value tFG. If FAF≦1.1 in step 420 and if FAF<0.9 in step 424, step 426 adds the value Y to the vapor concentration updating value tFG. Step 428 corrects the vapor concentration FGPG by adding the vapor concentration updating value tFG thereto, to complete the vapor concentration learning control. Then, the fuel injection time (TAU) calculation control (step 452) is carried out.

Figure 7:
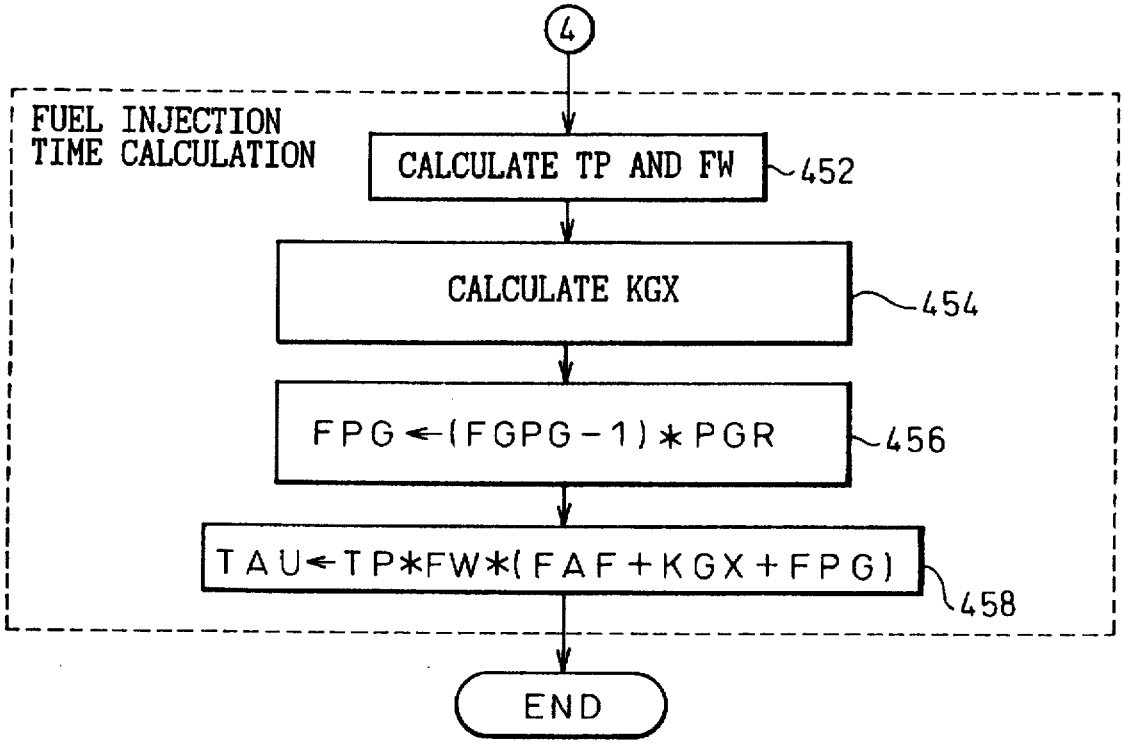
FIG. 7 is a flowchart showing a fuel injection time calculation routine according to the present invention.

The fuel injection time (TAU) calculation control of FIG. 7 will be explained. Step 452 refers to a map in the ROM 62 and finds a reference fuel injection time TP according to an engine revolution speed and an engine load (the quantity of intake air per engine revolution). At the same time, step 452 calculates a reference correction coefficient FW according to signals from the throttle opening sensor 9, water temperature sensor 51, and intake temperature sensor 3. The engine load may be estimated according to a pressure in the intake duct 13 and the engine revolution speed. Step 454 calculates an air-fuel ratio learning correction quantity KGX for a present pressure in the intake duct 13 according to the air-fuel ratio learning value KGj of an adjacent learning area by interpolation.

Step 456 calculates a purge-based air-fuel ratio correction quantity FPG according to the vapor concentration FGPG and purge ratio PGR as follows:

$$FPG \leftarrow (FGPG-1)*PGR$$

Step 458 calculates a fuel injection time TAU as follows $$TAU \leftarrow TP*FW*(FAF+KGX+FPG)$$

This completes the fuel injection quantity calculation routine. The fuel injector 21 of each cylinder is opened for the fuel injection time TAU at a crank angle calculated according to fuel injection timing provided by another routine.

Figure 8:
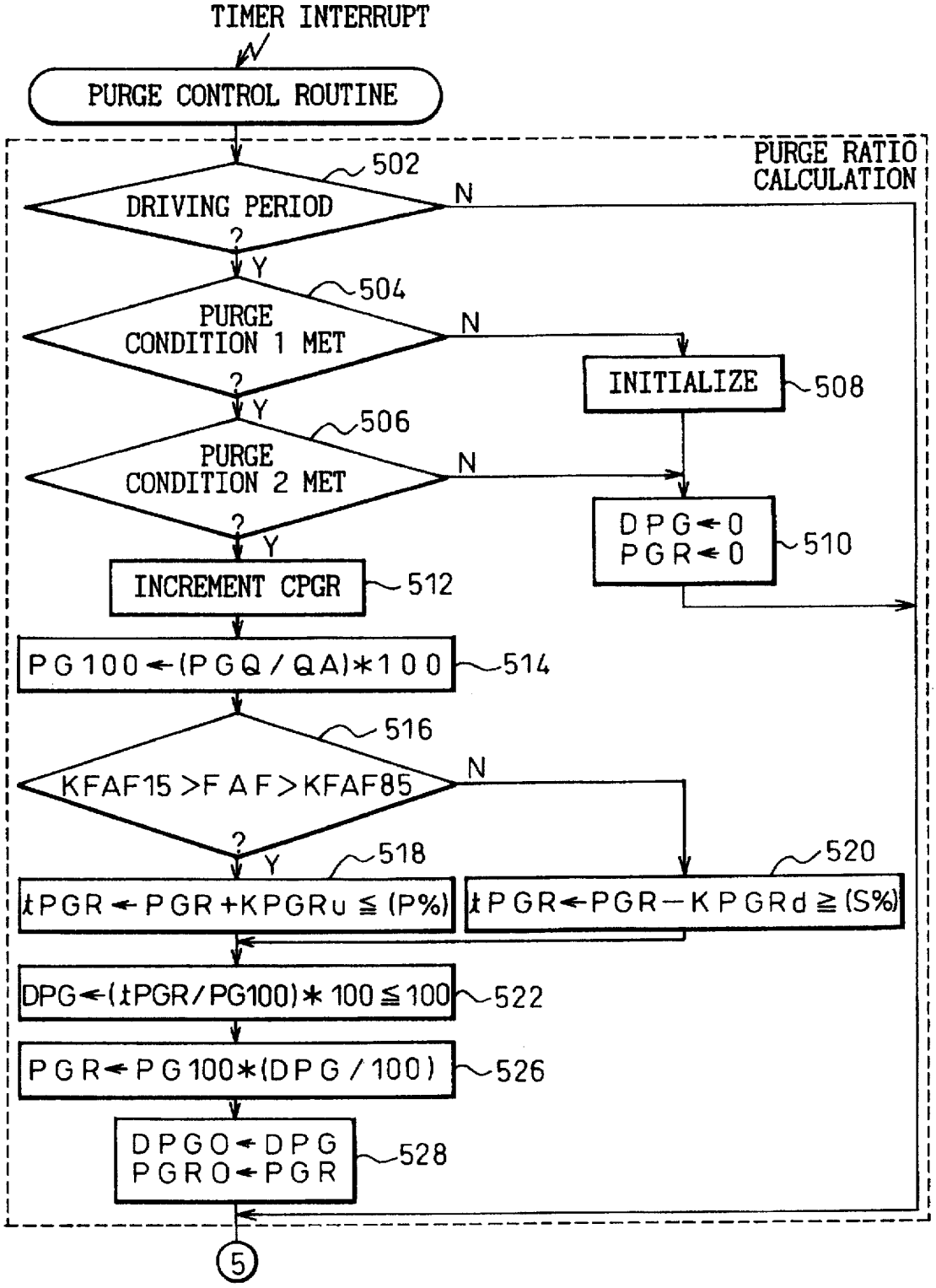
FIG. 8 is a flowchart showing a purge ratio calculation routine according to the present invention.
Figure 9:
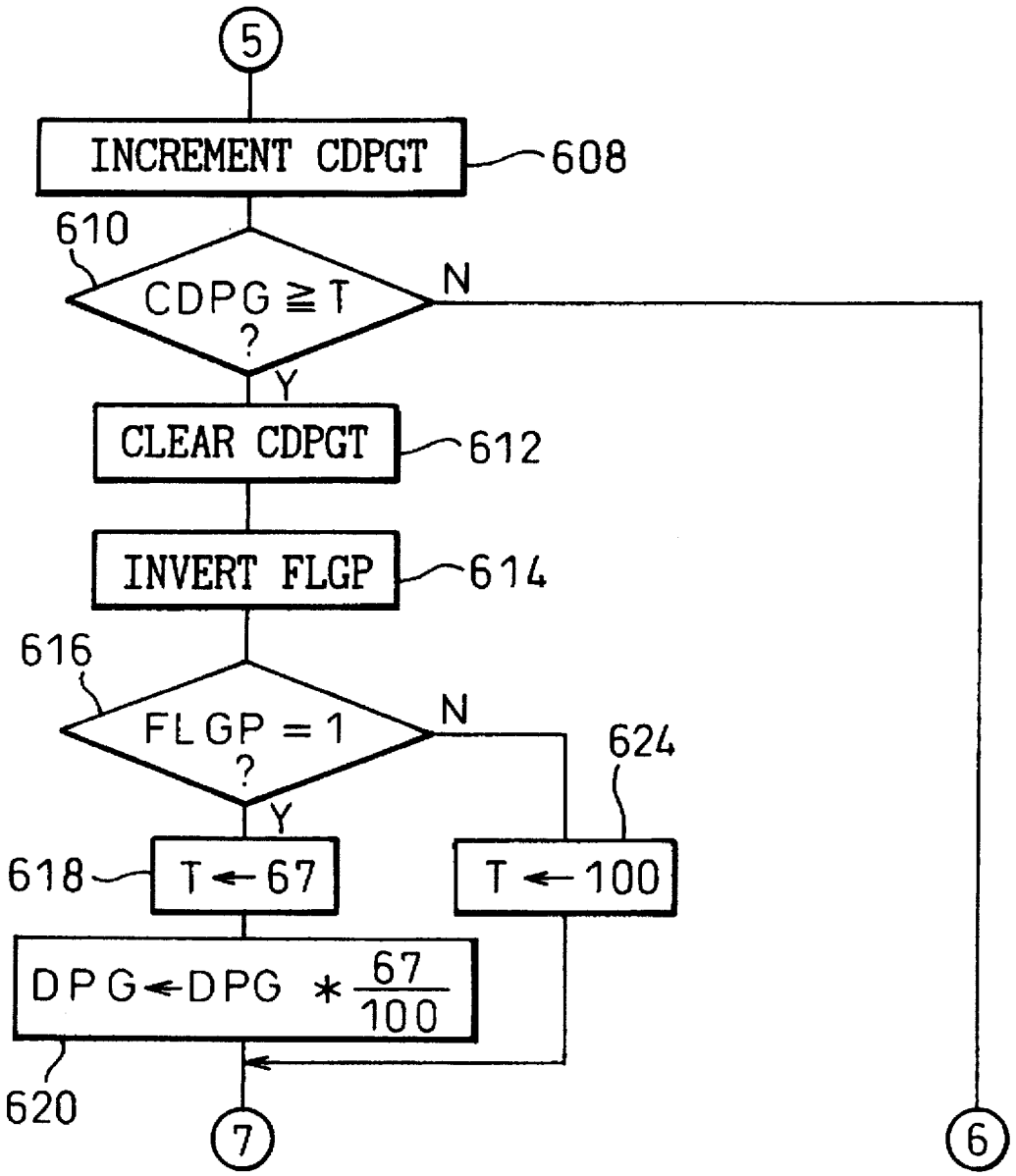
FIG. 9 is a flowchart showing a first driving period changing routine according to the present invention.
Figure 10:
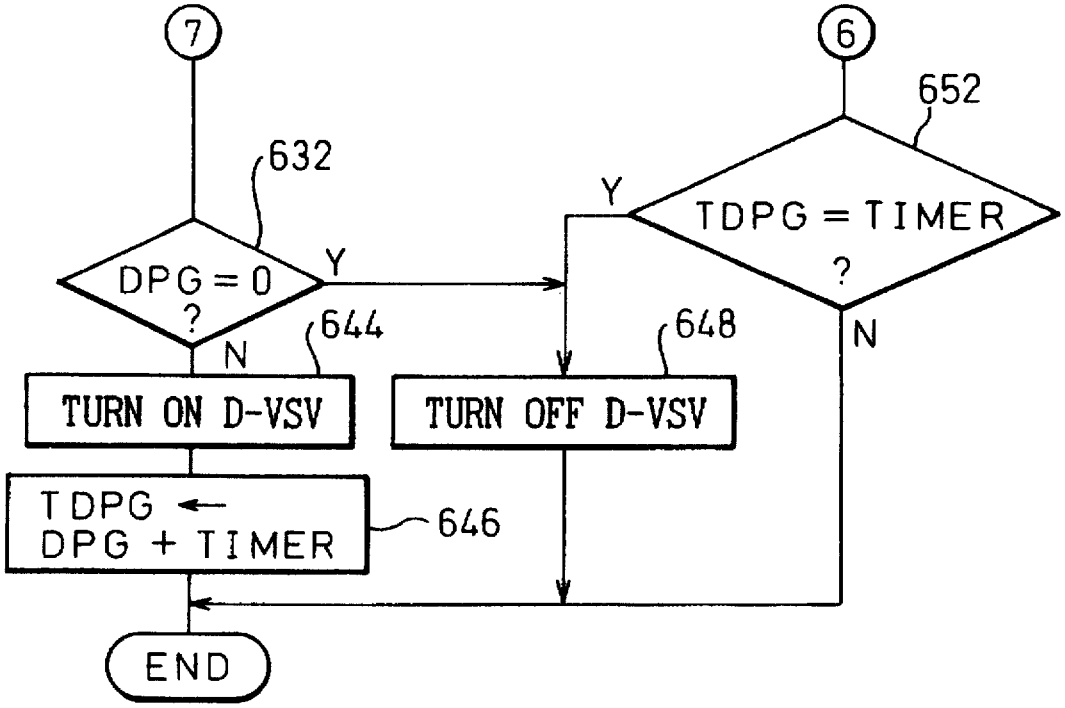
FIG. 10 is a flowchart showing a first valve controlling routine according to the present invention.

FIGS. 8 to 10 are flowcharts showing the purge control routine according to the present invention. The purge control routine is a timer interrupt carried out at regular intervals of, for example, 1 msec. This routine determines the duty factor (the ON period) of a pulse signal that controls the opening of the purge control valve (D-VSV) 41. The routine consists of a purge ratio (PGR) calculation routine of FIG. 8, a driving period changing routine of FIG. 9, and a valve controlling routine of FIG. 10, each of which is carried out at intervals of 1 msec.

The purge ratio calculation routine of FIG. 8 will be explained. Step 502 determines whether or not it is time to rise the pulse signal for driving the purge control valve 41. Namely, step 502 determines whether or not it is a valve driving period of, for example, 100 msec when the driving frequency of the purge control valve 41 is 10 Hz. If it is so, step 504 determines whether or not a purge condition 1 is met, i.e., whether or not the air-fuel ratio learning conditions are met. If the purge condition 1 is met, step 506 determines whether or not a purge condition 2 is met, i.e., whether or not fuel is being supplied and the air-fuel ratio learning completion flag XKGj is 1 for the learning area j in question.

Figure 11:
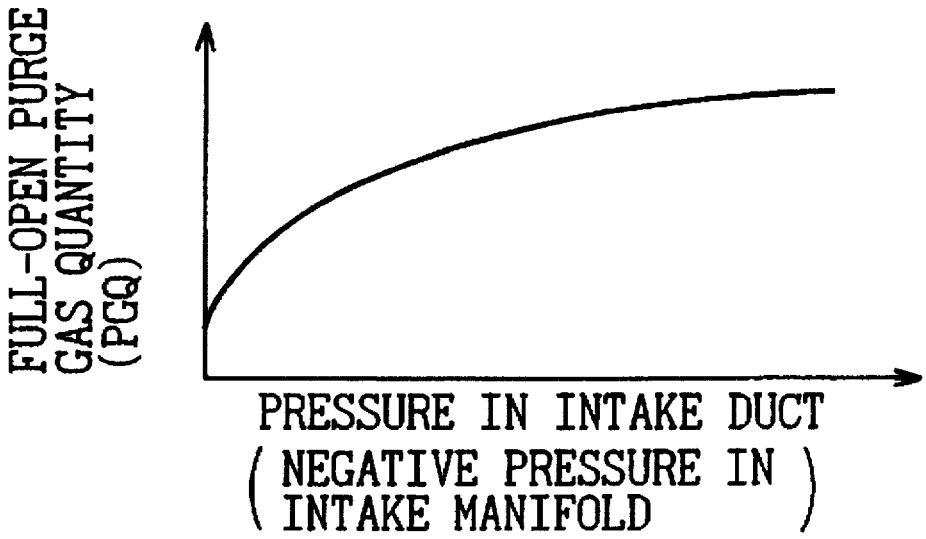
FIG. 11 is a characteristic diagram showing a relationship between an intake duct pressure and a purged fuel quantity with a purge control valve being fully opened.

If the purge condition 2 is met, step 512 increments a purge timer CPGR through the timer unit D. Step 514 refers to a map of FIG. 11 stored in the ROM 62 according to a pressure in the intake duct 13, finds a purge fuel quantity PGQ with the purge control valve 41 being fully opened, and calculates a purge ratio PG100 with the purge control valve 41 being fully opened according to the ratio of the purged fuel quantity PGQ to an intake air quantity QA. Step 516 determines whether or not the air-fuel ratio feedback correction coefficient FAF is within a given range, i.e., if KFAF15>FAF>KFAF85.

Figure 12:
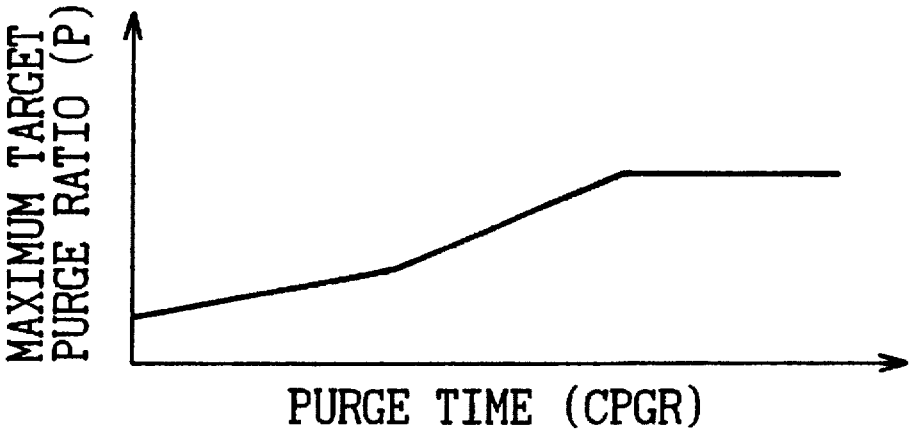
FIG. 12 is a characteristic diagram showing a relationship between a purge time and a maximum target purge ratio.

If KFAF15>FAF>KFAF85 in step 516, step 518 increases a target purge ratio tPGR by a given quantity KPGRu and limits the target purge ratio tPGR equal to or below a maximum target purge ratio P% that is determined according to a map of FIG. 12 and the purge timer CPGR. If FAF≦KFAF15 or FAF≧KFAF85 in step 516, step 520 decreases the target purge ratio tPGR by a given quantity KPGRd and limits the target purge ratio tPGR equal to or above a minimum target purge ratio S%, which is, for example, 0% or 0.5%. This prevents an air-furl ratio from fluctuating due to purged fuel.

Step 522 calculates a duty factor DPG as follows:

DPG←(tPGR/PG100)*100

Step 526 calculates an actual purge ratio PGR as follows:

PGR←PG100*(DPG/100)

Step 528 updates a preceding duty factor DPGO and a preceding purge ratio PGRO according to the DPG and PGR. Then, the driving period changing routine of FIG. 9 (step 608) is carried out.

If it is not the time to output the pulse signal for driving the purge control valve 41 in the valve driving period in step 502, the driving period changing routine (step 608) of FIG. 9 is carried out. If the purge condition 1 is not met in step 504, step 508 initializes related RAM data such as the preceding duty factor DPGO and preceding purge ratio PGRO to 0, and step 510 is carried out. If the purge condition 2 is not met in step 506, step 510 is carried out. Step 510 zeroes the duty factor DPG and purge ratio PGR, and the driving period changing routine (step 608) of FIG. 9 is carried out.

FIG. 9 is a flowchart showing the first driving period changing routine according to the present invention. Step 608 increments a count CDPG of a driving period timer CDPGT by one. Step 610 checks to see if CDPG≧T, where T is an initial value T (=100 msec). If CDPG≧T, step 612 is carried out, and if not, step 652 of FIG. 10 is carried out. The initial value T of this embodiment is 100 msec among two periods 100 msec and 67 msec for driving the purge control valve 41.

If CDPG≧T in step 610, step 612 clears the driving period timer CDPGT. Step 614 inverts a driving period flag FLGP, and step 616 is carried out. The flag FLGP is 0 after initialization. Accordingly, if FLGP=0, it means that the driving period of the purge control valve 41 is 100 msec. If FLGP=1, it means that the driving period of the purge control valve 41 is 67 msec. Step 616 checks to see if FLGP=1. If FLGP=1, step 618 sets T=67, and step 620 calculates a new duty factor DPG by multiplying the duty factor DPG calculated in step 522 of FIG. 8 by 67/100. If FLGP=0 in step 616, step 624 sets T=100. After the steps 620 and 624, step 632 of FIG. 10 is carried out.

FIG. 10 is a flowchart showing the first valve controlling routine carried out by the valve controlling unit B of the present invention. Step 632 checks to see if the duty factor DPG is 0. If DPG=0, i.e., if no fuel purge is carried out, step 648 is carried out, and if DPG≠0, i.e., if fuel purge is carried out, step 644 turns on the purge control valve 41. Step 646 calculates a valve OFF time TDPG as follows:

TDPG←DPG+TIMER where TIMER is incremented whenever the purge control routine is carried out. This completes the routine of FIG. 10.

If CDPG<T in step 610 of FIG. 9, step 652 of FIG. 10 checks to see if TDPG=TIMER. If not, the routine ends. If they agree with each other, step 648 is carried out. If DPG=0 in step 632, step 648 is carried out. Step 648 turns off the purge control valve 41 and terminates the routine.

Figure 13:
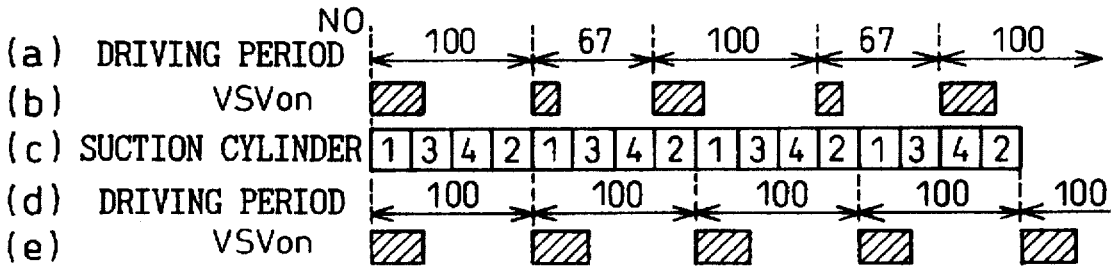
FIG. 13 compares the driving periods of a purge control valve between the present invention and the prior art, in which (a) shows alternating driving periods according to the present invention, (b) shows the open timing of the purge control valve according to the present invention, (c) shows cylinders in a suction stroke, (d) shows a fixed driving period according to the prior art, and (e) shows the open timing of the purge control valve according to the prior art.

FIG. 13 compares the driving periods of a purge control valve of a four-cylinder engine between the present invention and the prior art. An abscissa represents time. In the figure, (a) shows alternating driving periods according to the present invention, (b) shows the open timing of the purge control valve according to the present invention, (c) shows cylinders in a suction stroke, (d) shows a fixed driving period according to the prior art, and (e) shows the open timing of the purge control valve according to the prior art. According to the prior art, cylinders #1 and #3 draw purged fuel to make an air-fuel ratio therein rich, and cylinders #2 and #4 draw no purged fuel to make an air-fuel ratio therein lean. As a result, the prior art fluctuates a collective air-fuel ratio detected according to exhaust gas, to deteriorate exhaust purifying performance. On the other hand, the present invention properly distributes purged fuel to each cylinder.

The embodiment of FIGS. 8 to 12 alternates the two periods of 100 msec and 67 msec for driving the purge control valve 41. On the other hand, the prior art drives the purge control valve according to one of the driving periods of 100 msec and 67 msec. When the fixed period of 100 msec or 67 msec agrees with an engine cycle, specific cylinders, for example, the cylinders #1 and #3 in FIG. 13 draw purged fuel and become rich. The other cylinders #2 and #4 that draw no purged fuel become lean, thereby fluctuating an air-fuel ratio. On the other hand, the present invention alternates the two driving periods of 100 msec and 67 msec, to drive the purge control valve 41, thereby keeping an air-fuel ratio stable and preventing lean misfires. Even if the sum, 167 msec, of the two periods 100 msec and 67 msec agrees with an engine cycle, purged fuel is drawn two times within 167 msec to average the purged fuel among the cylinders, thereby stabilizing an air-fuel ratio and preventing lean misfires.

Figure 14:
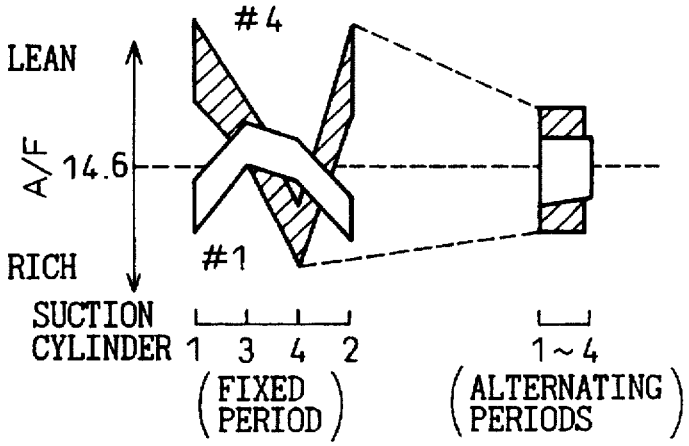
FIG. 14 compares fluctuations in an air-fuel ratio caused by purged fuel between the present invention and the prior art.

FIG. 14 compares fluctuations in an air-fuel ratio caused by purged fuel between the present invention and the prior art. An ordinate represents an air-fuel ratio. On an abscissa, suction cylinders 1, 3, 4, and 2 on the left side are of the prior art and their suction timing agrees with the open timing of the purge control valve 41. Suction cylinders 1 to 4 on the right side are of the present invention and their suction timing does not agree with the open timing of the purge control valve 41. According to the prior art, the cylinder 4 is lean and the cylinder 1 is rich when the suction timing of the cylinder 1 agrees with the open timing of the purge control valve 41, and when the suction timing of the cylinder 2 agrees with the same, the cylinder 4 is lean and the cylinder 1 is rich. When the suction timing of the cylinder 3 of the prior art agrees with the open timing of the purge control valve 41, the cylinders 1 and 4 are near the stoichiometric (theoretical) air-fuel ratio of 14.6. When the cylinder 4 of the prior art is a suction cylinder, the cylinder 1 is near the theoretical air-fuel ratio of 14.6 but the cylinder 4 is rich. On the other hand, the present invention keeps the cylinder 1 near the stoichiometric air-fuel ratio of 14.6 and the cylinder 4 near the same because the suction timing of the suction cylinders 1 to 4 alternately agrees with the open timing of the purge control valve 41.

As explained above, the driving period changing unit A of the present invention solves the problem of fluctuating an air-fuel ratio of the prior art (Japanese Unexamined Patent Publication No. 6-241129) that changes the driving period of a purge control valve to another when an engine cycle agrees with the driving period of the purge control valve. This prior art suddenly changes the quantity of purged fuel to fluctuate an air-fuel ratio when the driving period of the purge control valve is changed. Although the prior art carries out air-fuel ratio feedback control to bring the fluctuating air-fuel ratio to a target air-fuel ratio, it takes a time to stabilize the air-fuel ratio at the target air-fuel ratio. On the other hand, the driving period changing unit A of the present invention changes the driving period of the purge control valve from one to another, carries out duty control predetermined times (for example, one) at the changed driving period, and again changes the driving period to the original one (when two driving periods are changed from one to another). These operations are repeated. Even if the quantity of purged fuel periodically changes whenever the driving period of the purge control valve is changed from one to another, the purged fuel is temporarilly averaged among cylinders of the engine so that the purged fuel never continuously flows into a specific cylinder, or so that there may be no cylinder that receives no purged fuel. Namely, the present invention equally distributes purged fuel to each cylinder to prevent a fluctuation in an air-fuel ratio.

Figure 15:
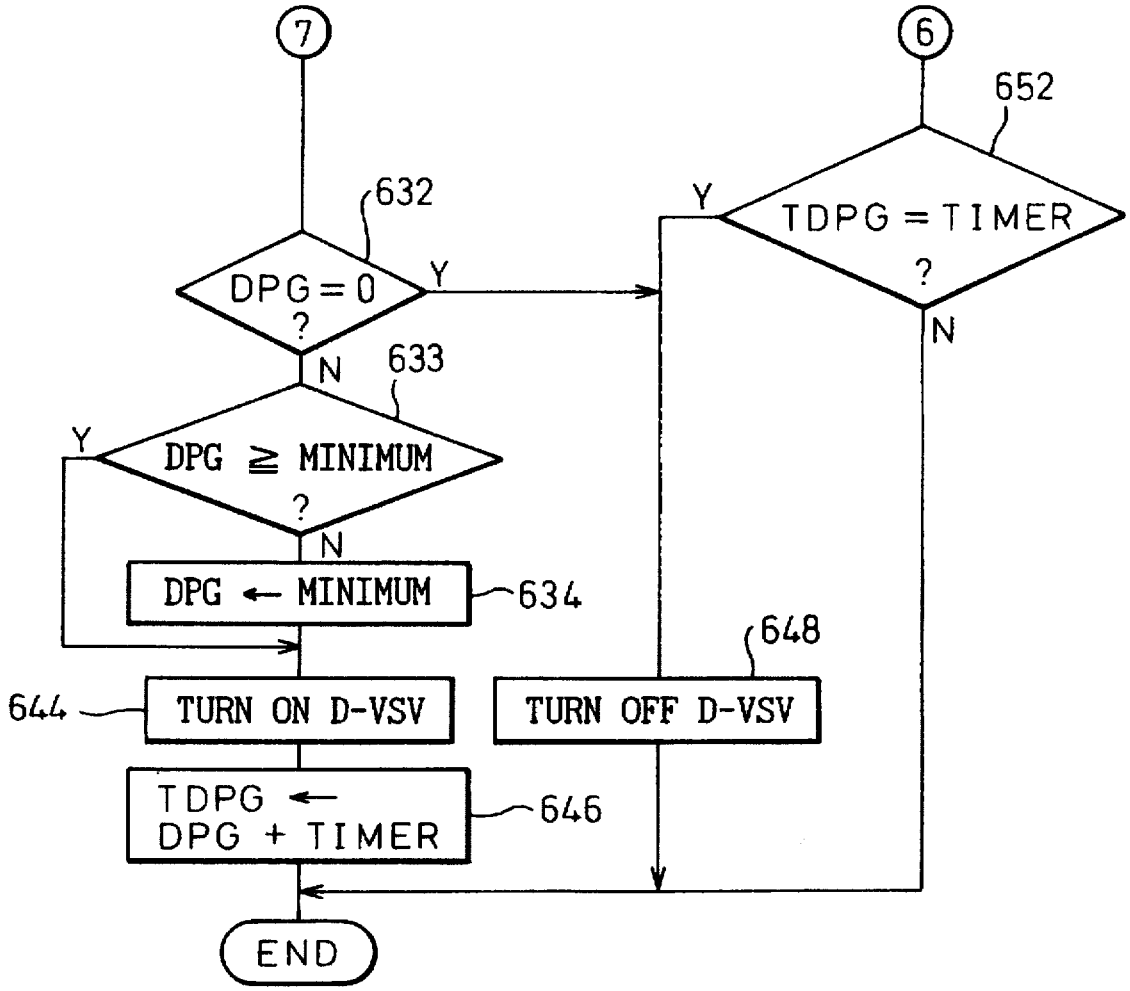
FIG. 15 is a flowchart showing a second valve controlling routine according to the present invention.

FIG. 15 is a flowchart showing the second valve controlling routine according to the present invention. This is different from the first valve controlling routine of FIG. 10 in that it additionally has steps 633 and 634 between steps 632 and 644 of FIG. 10. Steps 633 and 634 correspond to the duty factor setting unit C. If DPG≠0 in step 632, i.e., if the purge control is being carried out, step 633 determines whether or not the duty factor DPG is larger than a minimum. If DPG≧minimum, step 644 is carried out, and if not, step 634 sets DPG to the minimum. This minimum is a minimum time for opening the purge control valve 41. If the opening time of the purge control valve 41 is less than the minimum, it will not close but will be kept open. In the example of FIG. 15, the minimum is set commonly for the driving periods of 100 msec and 67 msec instead of setting a minimum for each driving period. Namely, the example of FIG. 15 sets the minimum according to the shorter driving period of 67 msec.

Figure 16:
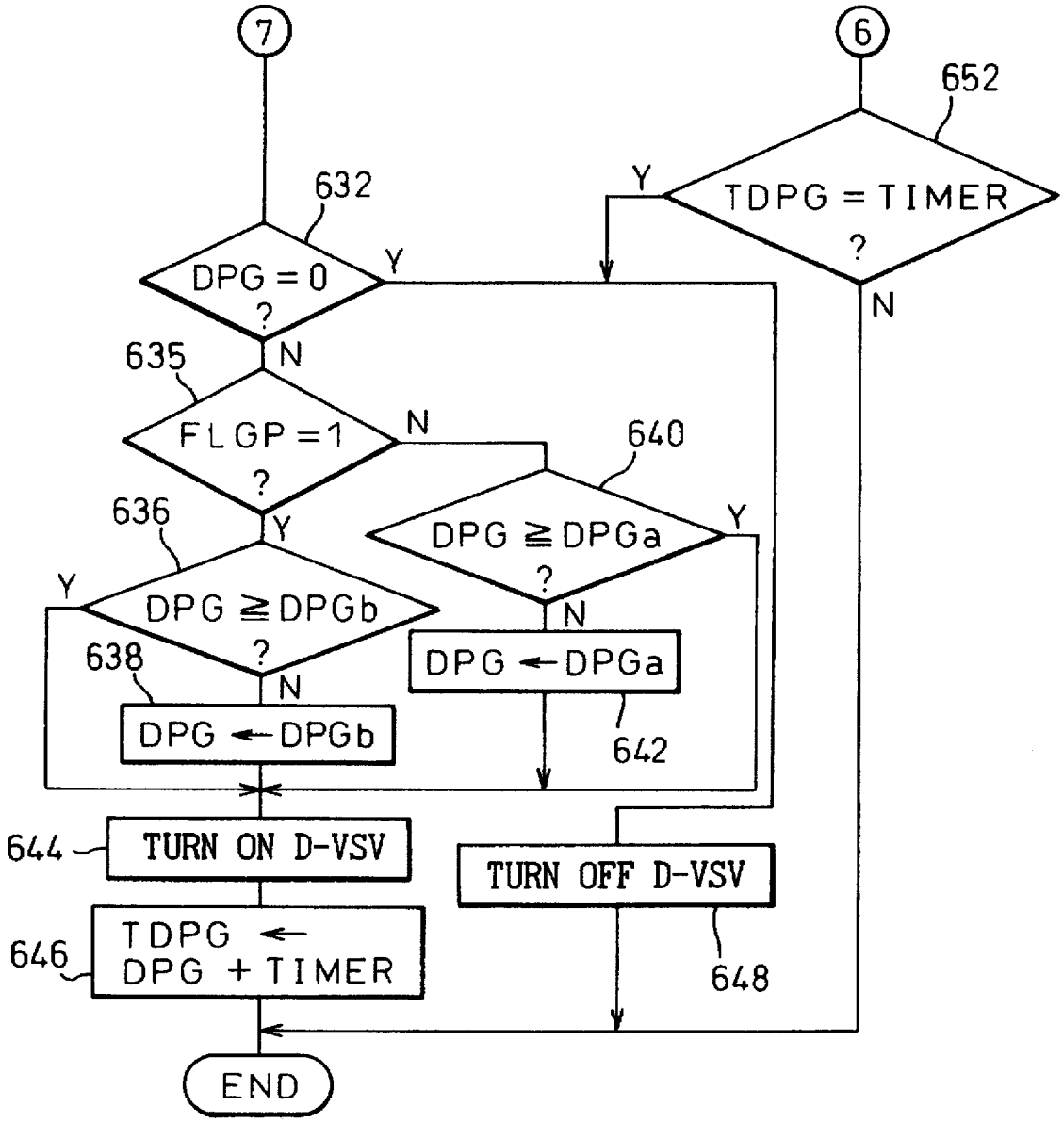
FIG. 16 is a flowchart showing a third valve controlling routine according to the present invention.

FIG. 16 is a flowchart showing the third valve controlling routine according to the present invention. This routine sets a minimum for each of the two periods for driving the purge control valve 41. The routine is different from the first valve controlling routine of FIG. 10 in that it additionally has steps 635 to 642 between steps 632 and 644 of FIG. 10. The routine of FIG. 16 sets minimums DPGa and DPGb for the two valve driving periods, respectively. If DPG≠0 in step 632, i.e., if the purge control is being carried out, step 635 checks the driving period flag FLGP to see if it is 1. If FLGP=1 to indicate the driving period of 67 msec, step 636 checks to see if DPG≧DPGb. If DPG≧DPGb, step 644 is carried out, and if not, step 638 sets DPGb to DPG, and step 644 is carried out. If FLGP=0 in step 635 to indicate the driving period of 100 msec, step 640 checks to see if DPG≧DPGa. If DPG≧DPGa, step 644 is carried out, and if not, step 642 sets DPGa to DPG, and step 644 is carried out.

Figure 17:
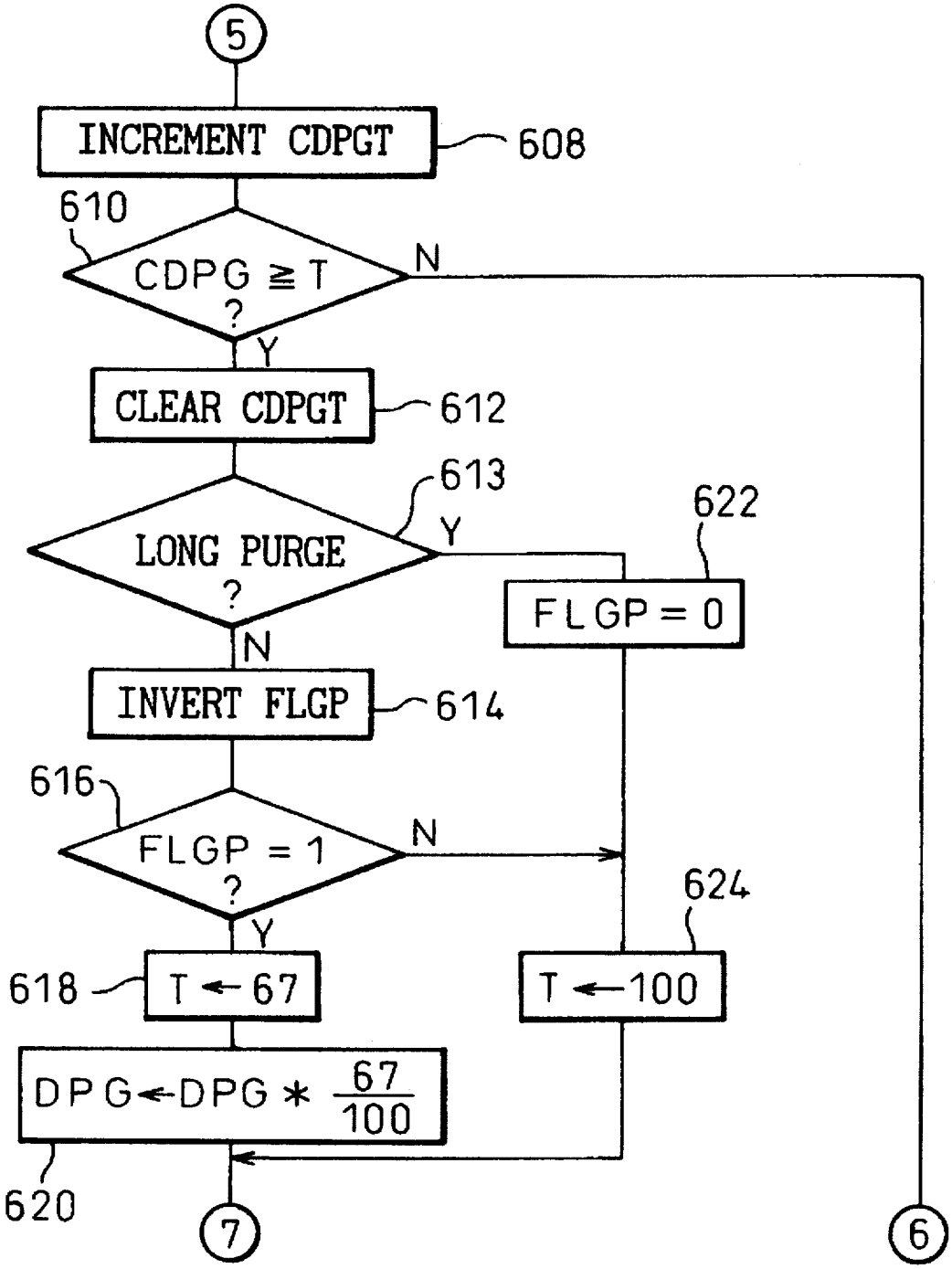
FIG. 17 is a flowchart showing a second driving period changing routine according to the present invention.

FIG. 17 is a flowchart showing the second driving period changing routine according to the present invention. This is different from the first driving period changing routine of FIG. 9 in that it additionally has step 613 between steps 612 and 614 of FIG. 9. It also additionally has step 622. Steps 613 and 622 correspond to the timer unit D. Step 613 checks to see if the purge timer CPGR set in step 512 of FIG. 8 is greater than a predetermined time. Until the purge timer CPGR becomes greater than the predetermined time, steps 614 to 620 are repeated. If the purge timer CPGR is greater than the predetermined time, step 622 sets the driving period flag FLGP to 0, and step 624 is carried out. This routine suppresses a fluctuation in an air-fuel ratio when a long time elapses from the start of the purge control, i.e., when the quantity of fuel adsorbed in the canister 37 becomes smaller. In this case, the driving period of the purge control valve 41 is fixed to 100 msec, to properly control the flow rate of purged fuel.

Although the above embodiment regularly alternates the two periods of 67 msec and 100 msec for driving the purge control valve 41, this does not limit the present invention. For example, three driving periods may be alternated among them. Also, one driving period may be repeated several times and then it is switched to another according to the operating conditions of the engine. A pattern of changing driving periods may properly be determined according to experiment.

Figure 18:
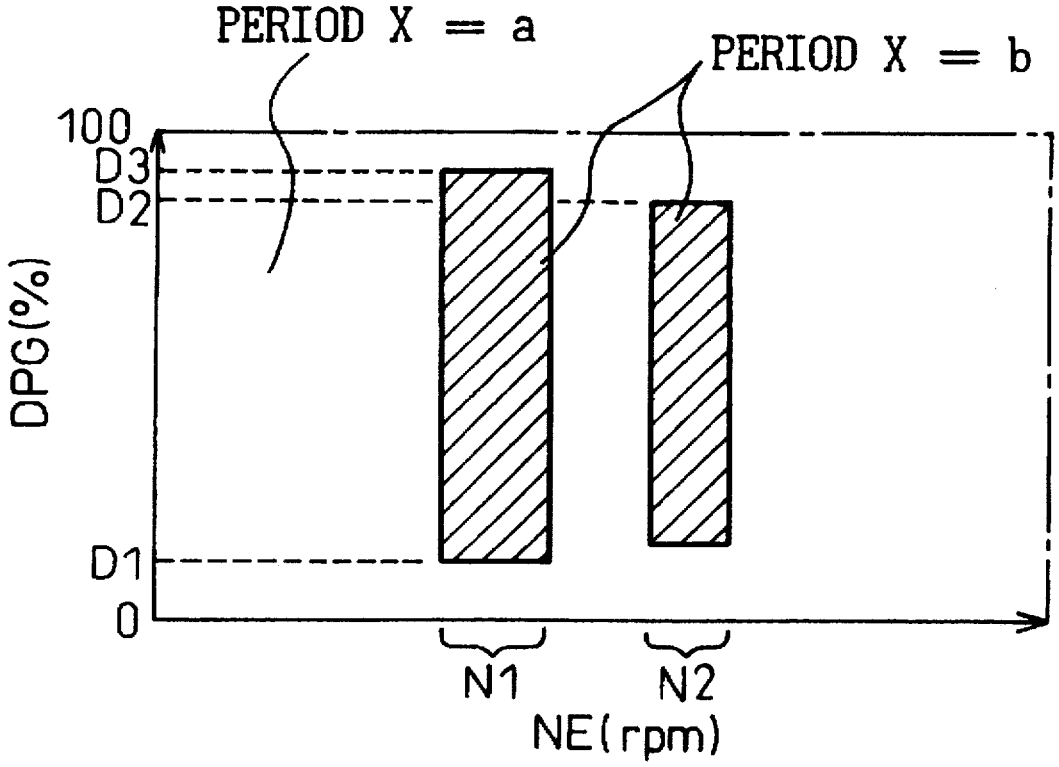
FIG. 18 is a map used to calculate a duty factor according to an engine revolution speed.

FIG. 18 is a map used to calculate a duty factor according to an engine revolution speed. The restricting unit E of the present invention restricts a driving period X according to a duty factor. The driving period X is changed from a to b when an engine revolution speed NE is in a range N1 and the duty factor DPG is D1≦DPG≦D3, or when NE is in a range N2 and D1≦DPG≦D2. In another case, the driving period X is kept at a. If the driving period X is changed from a to b when NE is in the range N1 and DPG<D1, or D3<DPG, or when NE is in the range N2 and DPG<D1, or D2<DPG, the quantity of purged fuel may fluctuate. Accordingly, the restricting unit E prohibits such a change. Namely, the restricting unit E prohibits a change in the driving period of the purge control valve 41 when the duty factor DPG is too low or too high, thereby maintaining good controllability of fuel to be purged.

Figure 19:
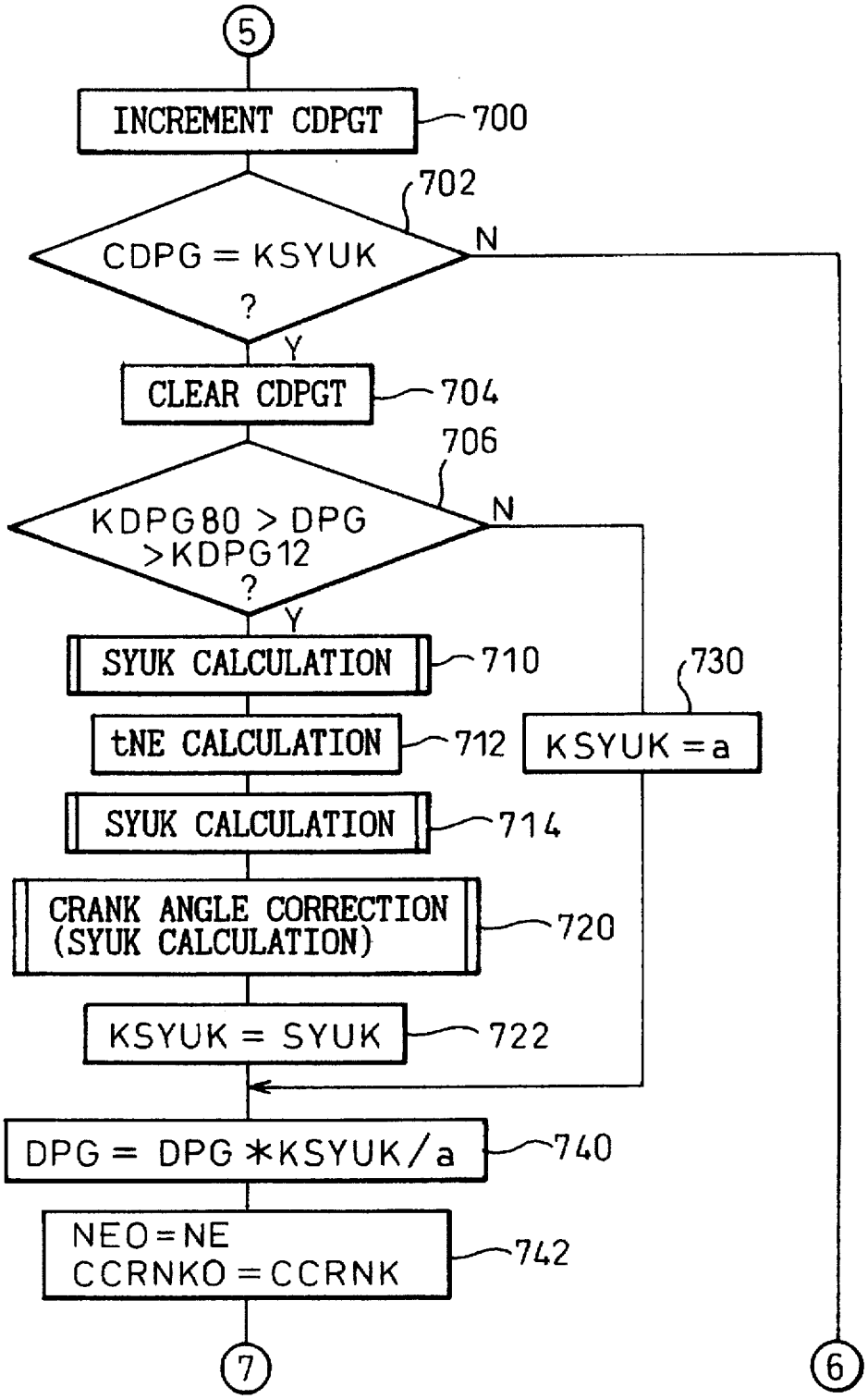
FIG. 19 is a flowchart showing a third driving period changing routine according to the present invention.

FIG. 19 is a flowchart showing the third driving period changing routine according to the present invention. Step 710 corresponds to the cylinder identifying unit and driving period setting unit. Step 720 corresponds to the first correction unit. Steps 712 and 714 correspond to the estimation unit and second correction unit. Step 700 increments a count CDPG of the driving period timer CDPGT by one. Step 702 checks to see if CDPG=KSYUK, where KSYUK is a period for driving the purge control valve 41 and is initially set to the period a (=100 msec). If CDPG=KSYUK, step 704 is carried out, and if not, step 652 of FIG. 10 is carried out.

If CDPG=KSYUK in step 702, step 704 clears the driving period timer CDPGT. Step 706 checks to see if 12<DPG<80 and determines whether or not the duty factor DPG influences purged fuel to be distributed to the cylinders of the engine. If 12<DPG<80, step 710 is carried out, and if not, step 730 is carried out.

Figure 21:
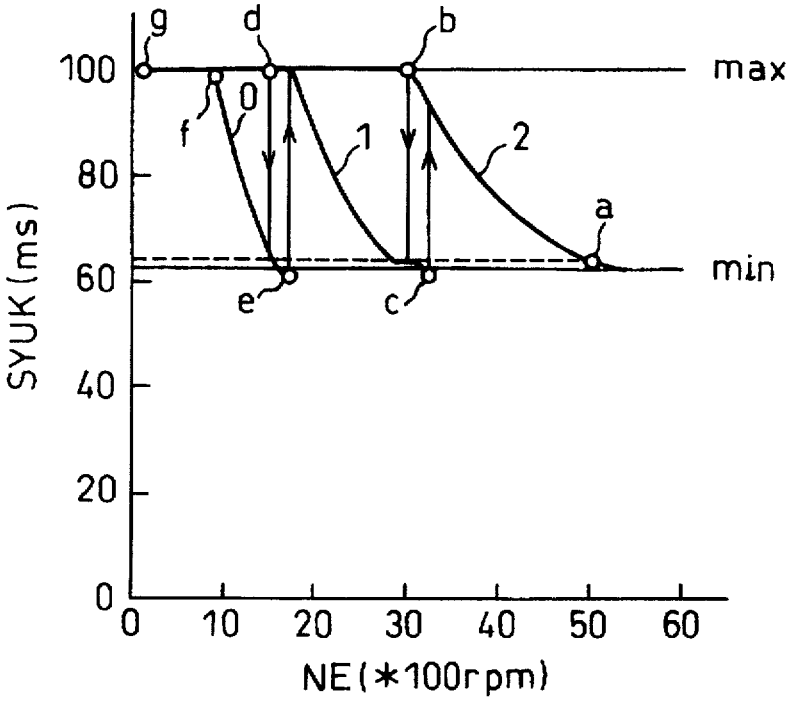
FIG. 21 is a map used to calculate an optimum driving period according to an engine revolution speed.

Step 710 will be explained later in detail with reference to FIGS. 20 and 21. Step 710 calculates an optimum driving period SYUK for driving the purge control valve 41 from a map of FIG. 21 according to an engine revolution speed NE at the start of the present driving period. The map is used to set the end of the present driving period, i.e., the start of the next driving period so that fuel to be purged in the next driving period may be drawn by a cylinder that is different from a cylinder that draws fuel purged in the present driving period. Step 712 calculates an estimated engine revolution speed tNE at the start of the next driving period as follows:

$$tNE=NE*(NEO/NE)*(KSYUK/SYUK)$$

where NE is an engine revolution speed at the start of the present driving period, NEO is an engine revolution speed at the start of a preceding driving period stored in step 742, KSYUK is a preceding actual driving period stored in step 742, and SYUK is an optimum driving period calculated according to the map of FIG. 21.

According to the estimated engine speed tNE, step 714 again calculates the optimum driving period SYUK for the purge control valve 41 according to the map of FIG. 21. Step 720 will be explained in detail later with reference to FIGS. 23 and 24. Step 720 corrects a crank angle and calculates a crank angle at the start of the present driving period and a crank angle at the start of the next driving period. The crank angles are determined in consideration of the intake stroke of each cylinder so that purged fuel may equally distributed to each cylinder. The crank angles are determined by changing the optimum driving period SYUK. Step 722 sets the optimum driving period SYUK calculated in step 720 to the actual driving period KSYUK, and step 740 is carried out. If step 706 determines that the duty factor DPG is out of the range that influences purged fuel to be distributed to the cylinders, i.e., if not 12<DPG<80 in step 706, step 730 sets the actual driving period KSYUK to the basic driving period of 100 msec, and step 740 is carried out.

Step 740 calculates the duty factor DPG as follows:

$$DPG=DPG*KSYUK/a$$

Step 742 stores the engine revolution speed NE and crank angle CCRANK for the start of the present driving period as engine revolution speed NEO and crank angle CCRANKO for the start of the next driving period. Then, step 632 of FIG. 10 is carried out.

Figure 20:
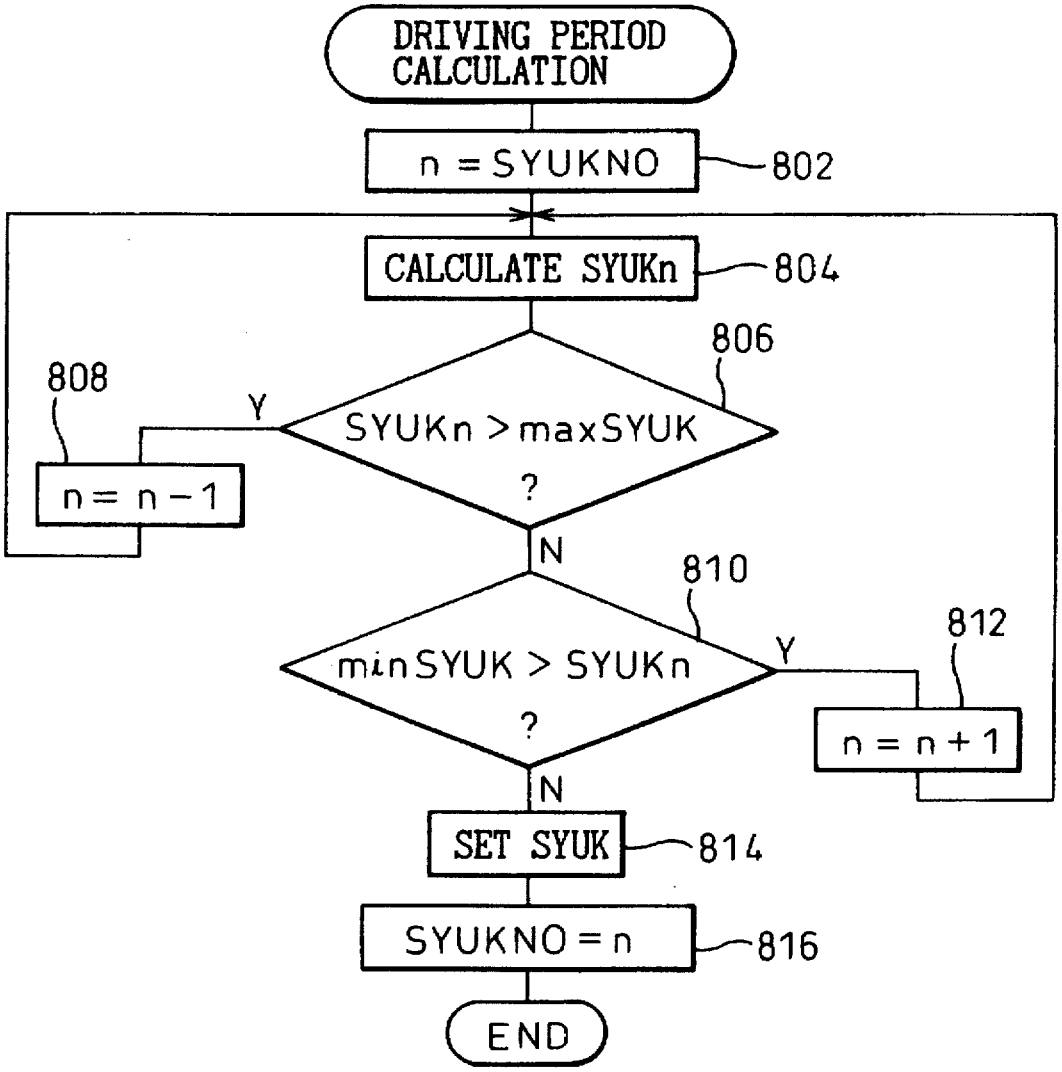
FIG. 20 is a flowchart showing the details of a driving period calculation routine contained in the flowchart of FIG. 19.

FIG. 20 is a flowchart showing the details of the driving period calculation routine (step 710) of FIG. 19, and FIG. 21 is a map used to calculate an optimum driving period according to an engine revolution speed. To calculate the optimum driving period SYUK corresponding to the engine revolution speed NE at the start of the present driving period, step 802 reads a map number SYUKNO written in step 816 during a preceding driving period and sets the map number SYUKNO to n. The map number SYUKNO is initially 0. Step 804 calculates a period SYUKn corresponding to the map number SYUKNO according to the map of FIG. 21. SYUKNO=0 corresponds to a period g-f-e, SYUKNO=1 to a period of d-c, and SYUKNO=2 to a period of b-a. The transition from the map number 0 to 1 (from 1 to 2), or from 1 to 0 (2 to 1) has a hysteresis to prevent hunting.

Step 806 determines whether or not the period SYUKn calculated in step 804 is larger than a maximum driving period maxSYUK (=100 msec). If SYUKn>maxSYUK, step 808 is carried out, and if not, step 810 is carried out. Step 808 calculates n=n−1. Step 810 determines whether or not SYUKn is smaller than a minimum driving period minSYUK (=65 msec). If minSYUK>SYUKn, step 812 is carried out, and if not, step 814 is carried out. Step 812 calculates n=n+1. Steps 806 to 812 change the map number SYUKNO, i.e., n so that a period may be within a range from the minimum to the maximum. Step 814 sets the period SYUKn calculated in step 804 to the optimum driving period SYUK. Step 816 sets the map number n to SYUKNO.

A method of forming the map of FIG. 21 will be explained.

Figure 22:
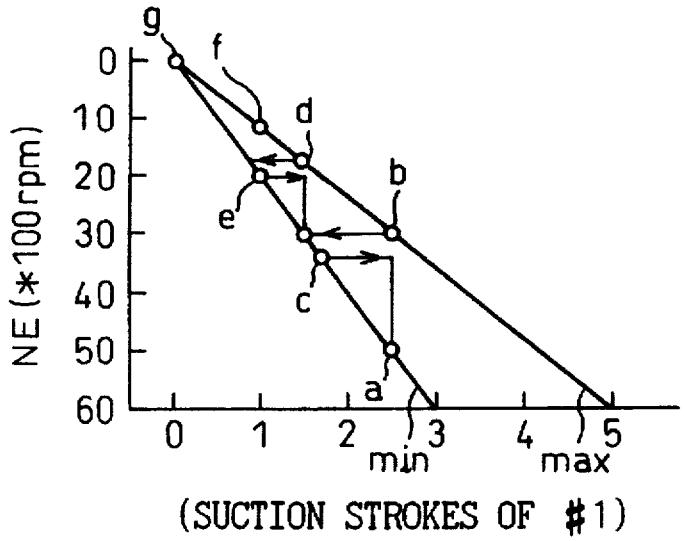
FIG. 22 shows a relationship among an engine revolution speed, a driving period, and suction strokes of a first cylinder.

FIG. 22 shows a relationship among an engine revolution speed NE, a driving period, and suction strokes of the first cylinder. An abscissa represents suction strokes of the first cylinder, and an ordinate represents engine revolution speeds NE. A straight line "max" corresponds to a driving period of 100 msec, and a straight line "min" corresponds to a driving period of 65 msec. Points "a" to "g" of FIG. 22 correspond to points "a" to "g" of FIG. 21. A cycle time corresponding to a crank angle of 720 degrees is expressed as 120000/NE. A cycle time at the point "a" is 26 msec because the corresponding engine revolution speed NE is 4615 rpm. To shift this phase by a crank angle of 360 degrees, a driving period of 65 msec (=26*2.5) is selected. A cycle time at the point "b" is 40 msec because the corresponding engine revolution speed NE is 3000 rpm. To shift this phase by 360 degrees, a driving period of 100 msec (=40*2.5) is selected. In this way, the map of FIG. 21 is formed from FIG. 22, to shift the start of the next driving period by a crank angle of 360 degrees, to change a cylinder that draws purged fuel to another. Although this embodiment prepares a map for shifting the start of the next driving period by a crank angle of 360 degrees, a map for shifting the same by a crank angle of 180 degrees is also usable. A map may properly be prepared according to the number of cylinders. For example, a map for an 8-cylinder engine may be prepared by shifting the start of a valve driving period by a crank angle of 90 degrees.

Figure 23:
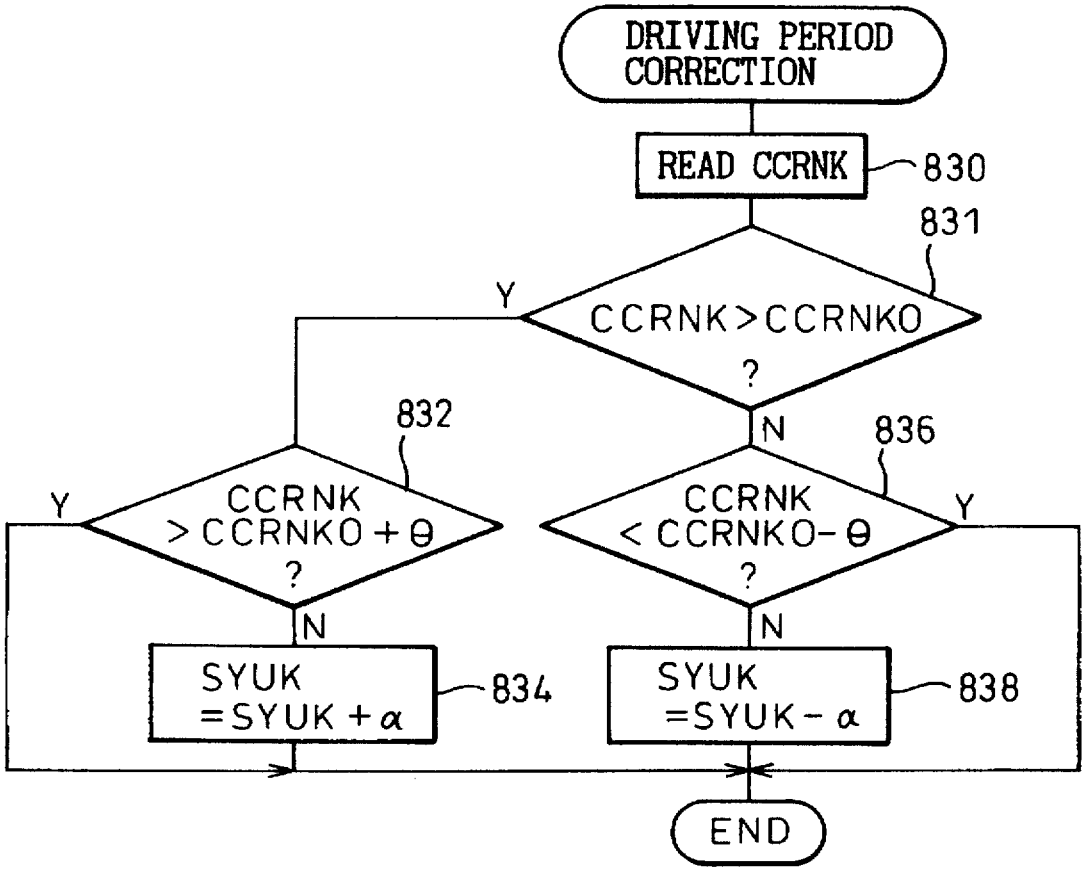
FIG. 23 is a flowchart showing a first correction routine contained in the flowchart of FIG. 19, for correcting a driving period.

FIG. 23 is a flowchart showing the first correction routine carried out in step 720 of the flowchart of FIG. 19, for correcting the valve driving period SYUK for driving the purge control valve 41. Step 830 reads a present crank angle CCRNK at the start of the present driving period. Step 831 compares the preceding crank angle CCRNKO stored in step 742 of FIG. 19 with the present crank angle CCRNK. If CCRNK>CCRNKO, step 832 is carried out, and if not, step 836 is carried out.

Step 832 compares CCRNK with CCRNKO+θ, where θ is set to shift the start of the next driving period more than a crank angle of 90 degrees. If CCRNK>CCRNKO+θ, the routine ends because a suction cylinder corresponding to the start of the present driving period is different from the preceding one. If not CCRNK>CCRNKO+θ, step 834 adds a correction time α to the optimum driving period SYUK, where the correction time α is calculated as follows:

$$\alpha=(120000/NE)*(1/4)$$

Since 120000/NE is equal to a crank angle of 720 degrees, the correction time α shifts the start of a driving period by one cylinder when the number of cylinders is four. The correction time α may be set to SYUK*(1/4) so that a suction cylinder at the start of the next driving period differs from a suction cylinder at the start of the present driving period. If CCRNK<360 and CCRNKO>360, the expression of step 832 is changed to CCRNK+720CCRNKO+θ. Step 836 checks to see if CCRNK<CCRNKO−θ. If CCRNK<CCRNKO−θ, the routine ends because a suction cylinder at the start of the present driving period is different from the preceding one. If CCRNK≧CCRNKO−θ, step 838 subtracts the correction time α from the optimum driving period SYUK. If CCRNK>360 and CCRNKO<360, the expression of step 836 is changed to CCRNK−720>CCRNKO−θ.

Figure 24:
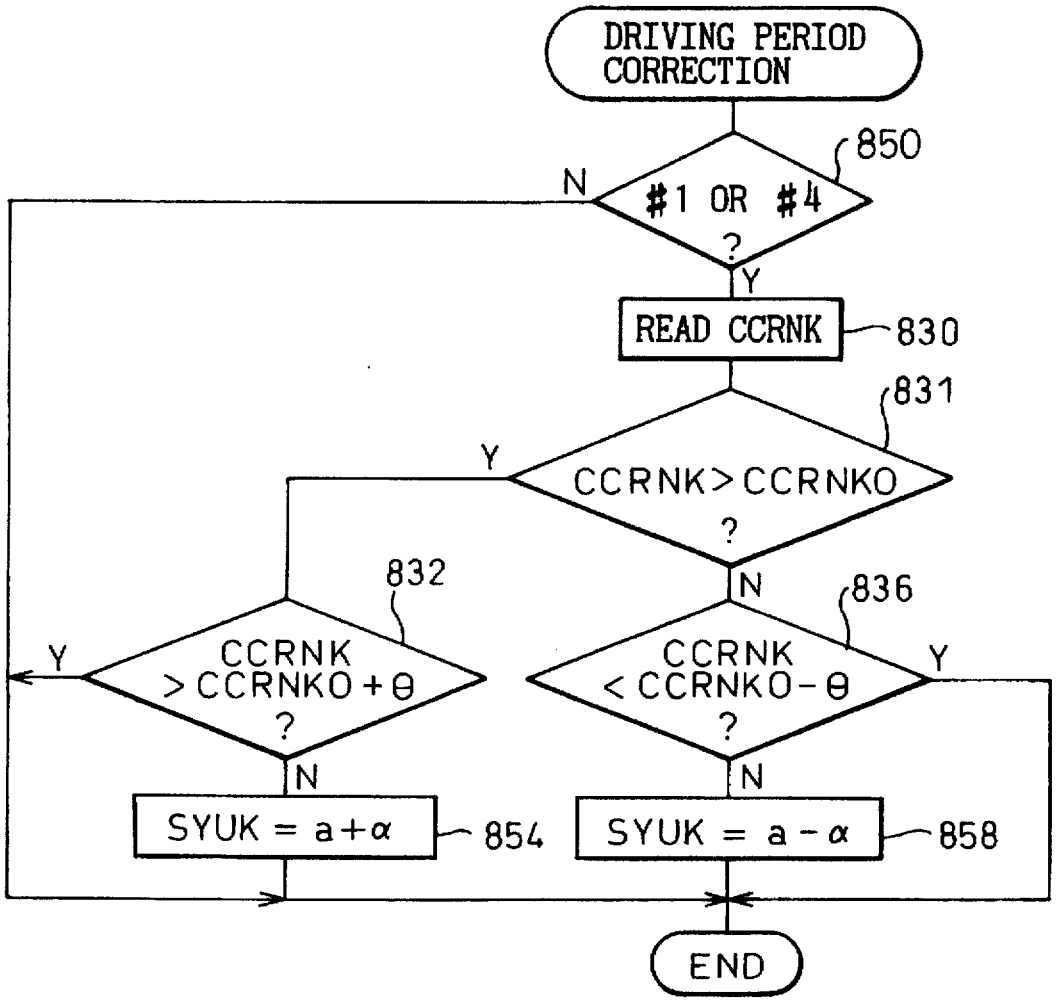
FIG. 24 is a flowchart showing a second correction routine contained in the flowchart of FIG. 19, for correcting a driving period.

FIG. 24 is a flowchart showing the second correction routine carried out in step 720 of the flowchart of FIG. 19, for correcting the valve driving period SYUK for driving the purge control valve 41. The flowchart of FIG. 24 differs from that of FIG. 23 in that it additionally has step 850 and has step 854 instead of step 834, and step 858 instead of step 838. Step 850 determines whether a suction stroke cylinder at the start of the present driving period is the first or fourth cylinder according to the crank angle CCRNK at the start of the present driving period. If the cylinder is the first or fourth cylinder, step 830 is carried out, and if not, it is determined that there is no fluctuation in an air-fuel ratio due to purged fuel, and the routine ends. Step 854 adds a correction time α to the basic driving period a (=100 msec). Step 858 subtracts the correction time α from the basic driving period a. Steps 850, 854, and 858 simplify the calculations of FIG. 23 and reduce load from the CPU 61 of the control unit 60.

As explained above, the present invention provides an evaporative control system of a multicylinder internal combustion engine, having a driving period changing unit and a valve controlling unit. The driving period changing unit employs a plurality of driving periods and switches them from one to another, and the valve controlling unit drives a purge control valve according to the alternating driving periods. As a result, the driving period of the purge control valve will never be synchronized with an engine cycle, and therefore, an air-fuel ratio in the engine will never fluctuate for the entire range of engine revolution speeds, thereby improving exhaust purifying performance.

The evaporative control system has a duty factor setting unit for setting a minimum valve open time for the purge control valve for each of the driving periods. According to the minimum valve open time, the valve controlling unit surely opens the purge control valve.

The evaporative control system has a timer unit for measuring an interval of purge control. If the measured interval is smaller than a reference value, it means that too much fuel is adsorbed in a canister to fluctuate an air-fuel ratio in the engine. Then, the driving period changing unit sequentially changes the driving period of the purge control valve from one to another and the valve controlling unit drives the purge control valve accordingly, to stabilize the air-fuel ratio. If the measured interval is larger than the reference value, it means that the amount of fuel adsorbed in the canister is too small to fluctuate the air-fuel ratio. Then, the driving period changing unit fixes the driving period of the purge control valve, to stabilize the air-fuel ratio and equally distribute the purged fuel to each cylinder.

The driving period changing unit has a restricting unit, which restricts the change of the driving period of the purge control valve if a duty factor is low or high, to correctly control the flow rate of purged fuel.

The driving period changing unit sets the driving period of the purge control valve so that the start of a driving period of the purge control valve may not continuously agree with the revolution phase of the engine, i.e., a crank angle. As a result, the driving period of the purge control valve is not continuously synchronized with an engine cycle, purged fuel is not drawn into a specific cylinder, and an air-fuel ratio is stabilized.

The evaporative control system has a cylinder identifying unit and a driving period setting unit, to prevent a specific cylinder from continuously drawing purged fuel. As a result, purged fuel is equally distributed to each cylinder of the engine, to stabilize an air-fuel ratio in the engine.

The evaporative control system has a first correction unit, to correct the driving period of the purge control valve so that a crank angle at the start of the present driving period of the valve may disagree with a crank angle at the start of the next driving period thereof. As a result, purged fuel is equally distributed to each cylinder to stabilize an air-fuel ratio in the engine.

The evaporative control system has an estimation unit for estimating an engine revolution speed and a second correction unit for correcting the driving period of the purge control valve according to the estimated engine revolution speed. As a result, purged fuel is not continuously drawn into a specific cylinder, purged fuel is equally distributed to each cylinder during a transient period, and an air-fuel ratio in the engine is stable even during the transient period.

It will be understood by those skilled in the art that the foregoing descriptions are preferred embodiments of the disclosed system and that various changes and modification may be made in the invention without departing from the spirit and scope thereof.

What is claimed is:

1. An evaporative control system for a multicylinder internal combustion engine having a canister for temporarily storing evaporated fuel from a fuel tank, a purge pipe for connecting the canister to an intake duct of the engine, and a purge control valve disposed in the purge pipe, for controlling the quantity of fuel purged from the canister into the intake duct, comprising:

driving period changing means for always changing, while the engine is working, the driving period of the purge control valve so that fuel purged from the canister is equally distributed to each cylinder of the engine; and valve controlling means for opening and closing the purge control valve according to the driving period set by the driving period changing means and a duty factor determined according to the operating conditions of the engine.

2. The system of claim 1, wherein the driving period changing means changes the driving period of the purge control valve among a plurality of driving periods according to a given order.

3. The system of claim 2, further comprising duty factor setting means for setting a minimum valve open time for the purge control valve for each of the driving periods, so that the valve controlling means may drive the purge control valve accordingly.

4. The system of claim 2, further comprising timer means for measuring an interval of purge control, so that the driving period changing means may fix the driving period of the purge control valve if the measured interval exceeds a reference value.

5. The system of claim 3, further comprising timer means for measuring an interval of purge control, so that the driving period changing means may fix the driving period of the purge control valve if the measured interval exceeds a reference value.

6. The system of claim 2, wherein the driving period changing means has restricting unit for restricting the change of the driving period of the purge control valve according to a duty factor.

7. The system of claim 3, wherein the driving period changing means has restricting unit for restricting the change of the driving period of the purge control valve according to a duty factor.

8. The system of claim 1, wherein the driving period changing means changes the driving period of the purge control valve so that the start of the driving period may not continuously agree with a revolution phase of the engine.

9. The system of claim 8, wherein the driving period changing means has:

cylinder identifying means for identifying a first cylinder that draws purged fuel in the present driving period of the purge control valve; and driving period setting means for setting the driving period of the purge control valve so that a second cylinder that draws purged fuel in the next driving period of the purge control valve may differ from the first cylinder.

10. The system of claim 8, wherein the driving period changing means has first correction means for correcting the driving period of the purge control valve according to a crank angle at the start of the present driving period of the purge control valve.

11. The system of claim 8, wherein the driving period changing means has:

estimation means for estimating an engine revolution speed; and second correction means for correcting the driving period of the purge control valve according to the estimated engine revolution speed.

* * * * *